US008557200B1

(12) United States Patent
Smith

(10) Patent No.: US 8,557,200 B1
(45) Date of Patent: Oct. 15, 2013

(54) ERGONOMIC PIPETTE TIP

(76) Inventor: James C. Smith, Hayward, CA (US)

( * ) Notice: Subject to any disclaimer, the term of this patent is extended or adjusted under 35 U.S.C. 154(b) by 0 days.

(21) Appl. No.: 13/506,632

(22) Filed: May 4, 2012

Related U.S. Application Data

(62) Division of application No. 12/215,029, filed on Jun. 23, 2008, now Pat. No. 8,202,495.

(51) Int. Cl.
*B01L 3/02* (2006.01)
*B01L 3/00* (2006.01)

(52) U.S. Cl.
USPC ..... 422/524; 422/525; 422/500; 422/501; 422/511; 73/863.32; 73/864; 73/864.16

(58) Field of Classification Search
USPC ..... 422/500–501, 511, 513, 524–525, 527, 422/534, 922; 73/863.32, 864, 864.01, 73/864.14, 864.16, 864.17
See application file for complete search history.

(56) References Cited

U.S. PATENT DOCUMENTS 5,232,669 A * 8/1993 Pardinas ..... 422/526
5,660,797 A * 8/1997 Jarvimaki ..... 422/525
6,171,553 B1 * 1/2001 Petrek ..... 422/522
7,641,859 B2 * 1/2010 Cote et al. ..... 422/522
8,071,050 B2 * 12/2011 Smith ..... 422/501
8,148,168 B2 * 4/2012 Gjerde et al. ..... 436/178
8,163,256 B2 * 4/2012 Cote et al. ..... 422/524
8,192,699 B2 * 6/2012 Ziegmann et al. ..... 422/524
2004/0072375 A1 * 4/2004 Gjerde et al. ..... 436/541
2005/0158214 A1 * 7/2005 Cote et al. ..... 422/100

* cited by examiner

*Primary Examiner* — Brian R Gordon

(57) ABSTRACT

An ergonomically designed pipette tip that can be securely mounted to a barrel of a pipetter yet is designed to substantially reduce the axial force necessary to install and eject the pipette tip from the pipetter thus reducing the injuries resulting in repetitive stress injury to the thumb and hand. The new ergonomic pipette tip incorporates a separate sealing member constructed from an elastomer that is coupled to the more rigid and chemically inert elongated tubular member that becomes the receptacle for transferring the fluid sample aspirated by the pipetter. The new elastomeric sealing member allows for greater sealing capability or squeeze between the pipetter barrel and the new pipette tip while lowering the coefficient of friction between the mating parts, thus decreasing the axial ejection forces require to overcome the breakaway friction between the new ergonomic pipette tip and the pipetter.

30 Claims, 11 Drawing Sheets

ERGONOMIC PIPETTE TIP

CROSS REFERENCE TO RELATED APPLICATIONS

This is a divisional application regarding patent application Ser. No. 12/215,029 filed Jun. 23, 2008 now U.S. Pat. No. 8,202,495, the contents of which are incorporated herein for reference in its entirely.

FIELD OF INVENTION

This invention relates to improvements in disposable pipette tips for pipetters or other liquid handling products. More particularly, a pipette tip that is ergonomically designed for air displacement pipetters that can be sealingly and securely mounted to a pipetter barrel that is specifically engineered to reduce the amount of axial force necessary to install and eject the ergonomic pipette tip from the pipetter.

BACKGROUND OF INVENTION

Air displacement pipetters with disposable pipette tips have been used in the medical and laboratory industries for many years. The main reason for such continual acceptance comes from the fact that after each use the pipette tip has traditionally been disposed of thereby limiting the possibility of cross contamination between samples. However as tests become more critical and the need to perform many tests from a limited amount of sample quantity became important, laboratory technicians have begun to have problems. These problems or errors could be contributed to operator use or fatigue, which often causes splashing of the sample. The sample could also aerosol during aspiration of the fluid, or the fluids contaminated gases can flow through the pipette tip upward into the calibrated barrel in the form of air borne contaminates. Even the smallest amount of dispensing error causing volume discrepancy or particles left behind on the barrel of the pipetter from previous tests can invalidate, or skew the evaluations of new test samples causing hours or even days of laboratory research to be wasted.

A researcher's work requires a high degree of volume consistency between samples and when hundreds of filtered or unfiltered pipette tips are used in just one procedure or test, the work may be invalid because of the inaccuracies in these sample volumes due to the precision and accuracy of the volumes dispensed. This is sometimes due to operator fatigue because of the excessive amount of force required to install and replace the disposable pipette tips insuring that a hermetic seal is made between the pipetter barrel and the pipette tip. This is very difficult because if the user does not provide enough downward force, the pipette tip seal may have a leak path which can cause volume discrepancies.

Usually, in mounting a pipette tip on a mounting shaft or barrel of a pipetter, a user, exerting a downward force of between twelve to eighteen pounds, drives the pipetter barrel axially into the upper portion of the pipette tip a distance which to the user seems sufficient to create a air tight seal and a stable non-rocking axial position. On occasion, in a mistaken attempt to improve the seal or axial position, a user will exert a downward insertion force up to twenty-five pounds. Since most pipette tips are formed of a relatively rigid plastic material such as polypropylene, the annular stretching of the pipette tip required to accommodate movement of the pipette tip onto the pipetter barrel is minimal. The inner surface and side walls of the proximal portions of most pipette tips are axially tapered at a one to one and a half degrees and mate with the distal end of the pipetter barrel to form an axially elongated frustoconical annular sealing band. The sealing band is dimensioned to stretch outwardly ("hoop stretch") as the distal end of the elongated generally shaped conical pipetter barrel mounting shaft is forced into the proximal end of the pipette tip to firmly seat the tip on the barrel and to create an axially elongated annular air tight seal between the sealing band and the pipetter barrel—hopefully maintaining a non-rocking stable axial position. In some instances, contact occurs between the pipetter's ejector sleeve and the upper top surface of the entrance to the pipette tip. This contact, depending on the amount of force and the angle of insertion by the user is not consistent and only provides minimal increase, if any, to the stability and lateral support of the pipette tip in maintaining its axial perpendicularity to the sealing band.

The more firmly a pipette tip is mounted or wedged onto the barrel of the pipetter, the greater the axial force which a pipetter user must generate by thumb and hand action to eject the pipette tip from the barrel when a tip replacement is desired. In practice, it is not uncommon for axial forces exceeding fifteen pounds to be generated by the pipetter users thumb and hand in driving a pipette tip from a mounting shaft. Over several and repeated ejection operations, particularly with multi-channel pipetters where substantially greater axial ejection forces are required, the thumb and hand of the user become physically stressed often resulting in repetitive stress injury to the thumb and hand and in extreme cases, carpal tunnel syndrome.

Because of the length of the sealing region and the relatively thick sidewall of the standard pipette tip, large plastic forces in the tip material resist such outward hoop stretching and require exertions of large axial forces to mount these standard pipette tips onto the pipetter barrels and create the necessary air and fluid type seal. In an effort to reduce the hand and finger forces which pipetter users must generate, some manufactures have reduced the annular sealing region of the sidewall of the pipette tip form 0.030-0.040 inch (0.75-1.00 mm) to 0.008 to 0.020 inch (0.20 to 0.50 mm) trying to provide a more resilient surface with minimal success. While others have decreased the amount of interference between the outer diameter of the pipetter barrel and the inner diameter of the mating sealing zone of the pipette tip to 0.003 inch (.0.075 mm) or about the width of a human hair as described in U.S. Pat. No. 6,168,761. As one can imagine, the less interference between these two matting surfaces will reduce the overall axial force necessary to install and eject the pipette tip from the pipetter but at what price. To maintain consistent sealing of two manufactured parts, the pipette tip being of plastic origin, and the barrel sometimes molded plastic or manufactured from stainless steel is very difficult and requires extremely tight manufacturing tolerances below +/−0.001 inch (+/−0.025 mm). The fact is that most pipette tips are manufactured from polypropylene which has one of the higher shrink rates of plastic materials makes this even more difficult to achieve.

When plastic parts are manufactured, a tool is created and the allowance of mold shrinkage must be made. Mold shrinkage of thermoplastic materials is very complex because it is affected by so many factors. For polypropylene, a major factor is cooling rate. Generally, higher shrinkage's result from slower cooling rates, which is why thicker parts shrink more than thinner parts. It simply takes longer to remove heat from thicker parts. Thus, the golden rule for plastic part design is to maintain consistent wall thickness or wall sections unlike that of the new pipette tips mentioned above which reduce the wall sections for example from 0.040 to 0.010 in sealing areas to help reduce the hoop stress but can causes other potential problems such as dimensional stability.

Further, polypropylene will continue to shrink and crystallize for several days or weeks after molding. Studies of shrinkage versus time show that most of the shrinkage takes place within the first 24 hours after molding. A small amount of additional shrinkage will occur in the next 24 hours, followed by incremental amounts (that are difficult to measure) for two to four weeks. Mold shrinkage for polypropylene can vary from about 0.010 inch/inch. (0.025 mm/mm) to about 0.030 inch/inch. (.0.750 mm/mm), depending on part thickness, formulation, and processing conditions.

Exposure of molded parts to different temperatures and humidity can also cause thermal expansion or contraction resulting in additional part dimensional changes that can occur during shipment of parts by truck, train or air freight. Still further, climatic changes within different parts of the world or within laboratories can also change the dimensional characteristic of these plastic parts and cause unknown changes that can result in leakage between parts causing volume discrepancy which can invalidate, or skew the evaluations of new test samples causing hours or even days of laboratory research to be wasted. Plastics, unlike metal parts are very sensitive to temperature variations and can grow or shrink depending on the environment that they are in.

In an effort to overcome the dimensional instability of plastic pipette tips and reduce the overall axial forces required to install and eject these parts from pipetters, some manufactures have offered a rubber interface on their pipetter barrels for sealing. For example, the Brinkman Instrument Company has included o-rings on the pipetter barrels of its Transferpipette 8/12 to insure the plastic pipette tips maintain air tight seals over dimensional variations between parts while staying firmly mounted during use. The interface concept is good, however, due to the volume of usage of the many plastic pipette tips that are engaged and released again and again over the o-ring surface, the o-ring material begins to wear and thus the plastic pipette tips no longer stay firmly on the pipetter barrels. In addition, the o-rings wear particles can sometimes mix with the sample fluid being transferred and potentially cause contamination to the fluid samples.

Still further, a standard pipette tip as illustrated in U.S. Pat. No. 5,660,797 incorporates a elongated inner collar made from a softer material having a back surface in contact with the inside surface of the pipette tip as shown in FIG. 1 as prior art. The secondary softer material of the elongated sealing collar 80 helps to promote sealing of the pipetter barrel as the elongated collar inner surface 82 surrounds the pipetter barrel by frictional fit as shown and described in FIG. 1 and FIG. 1A of the drawings and application. The large surface area created by the softer inner surface 82 is counter-productive in reducing the axial forces needed to install and eject this pipette tip. The elongated sealing collar 80 surrounds the mating pipetter barrel 48 promoting sealing but increases the frictional interference between the two mating parts creating a high coefficient of friction (the materials do not slide past each other easily). The static or breakaway friction of theses two dissimilar materials in combination with the increased surface area of the mating surfaces requires substantially greater axial forces to eject the pipette tip 79 from the pipetter barrel 48 than prior art configurations. This is especially apparent do to the inherent properties of the softer material to grab the mating pipetter barrel surface unlike the more rigid polypropylene material which has a much lower coefficient of friction. The increased surface contact of the softer material can promote better sealing as was the intention of the invention but the combination of increased surface area of the soft material and no limitation to the axial depth of penetration of the pipetter barrel into the pipette tip can cause more difficulty and increased axial forces in removing the pipette tip from the pipetter than prior art tip configurations. Therefore, this causes thes thumb and hand of the user to become physically stressed which can often resulting in repetitive stress injury. Lastly the structure of the above mentioned pipette tip also does not provide lateral mounting stability unless in those rare instances that the pipette tip is jammed upward against the bottom of the pipetter ejector sleeve providing minimal lateral stability of the pipette tip onto the barrel which there is no description thereof.

While some of the noted pipette tips above have shown some improvement with respect to the axial forces required to install and eject the pipette tip from the pipetter barrel, some have not. The reduced wall sections and the minimal interference fit between the pipetter barrel and the mating annular sealing region are not consistently reliable over a broad range of temperature variations and climates. The use of rubber-like materials to increased the sealing capability of the pipette tip is an improvement over the prior art for sealing, however, the addition sealing capability does not assure the reduction in the axial forces require to mount and eject the pipette tip from the pipetter.

Accordingly, there is a need for an improved ergonomically designed disposable pipette tip which will easily and stably mount onto a pipetter barrel mounting shaft and subsequently be ejected by a substantially reduced pipetter tip ejection force than existing standard disposable pipette tips in the market place today.

For a better understanding of the invention and how this new ergonomic pipette tip overcomes these disadvantages, reference is made to the following Summary, Description of Drawings and the Detailed Description of Invention.

SUMMARY OF INVENTION

The present invention relates to an Ergonomic Pipette Tip specifically engineered to reduce the axial forces require for insertion and ejection of the pipette tip from the pipetter while increasing the sealing effectiveness of the new ergonomic pipette tip to the barrel of the pipetter. In practice, it is not uncommon for axial forces exceeding fifteen pounds to be generated by the pipetter user's thumb and hand in driving a pipette tip from a mounting shaft or a pipetter barrel. Over several and repeated ejection operations, particularly with multi-channel pipetters where substantially greater axial ejection forces are required, the thumb and hand of the user become physically stressed often resulting in repetitive stress injury to the thumb and hand and in extreme cases, carpal tunnel syndrome.

It is the object of this invention to improve a pipetting device that is of the kind described before. Today's requirement for liquid handling pipette tips require specifically designed ergonomically friendly pipette tips that allow for the use of ergonomic pipette tips onto standard pipetters. The improved ergonomic pipette tips can be easily and securely mounted on and ejected from the pipetter barrel by application of relative small axial forces. These ergonomic pipette tips can be manufactured with a sealing member that is constructed from a secondary elastic material or an elastomer. The sealing member is engineered to expand about the interfacing pipetter barrel thus promoting a more resilient yet sealingly attachment with less friction than prior art. This is accomplished by the material and shape of the new sealing member which reduces the amount of surface area in contact with the pipetter barrel. The installation and ejection of the new pipette tip of the present invention requires the pipette tip user to generate very little hand and thumb forces, less than three and preferably below one pound of force in that repeated mounting and ejection of these new ergonomic tips is unlikely to result in repetitive stress injury.

Repetitive Stress Injury or RSI is a blanket name that is used to describe many different types of soft tissue injury including carpel tunnel syndrome and tendonitis. A mixture of bad ergonomics, stress, and repetitive motion usually causes it. Tendon inflammation resulting from repetitive work, such as uninterrupted pipetting with existing hard to use pipette tips, can cause carpal tunnel symptoms. Repetitive hand and wrist action often results in subcutaneous tissues becoming injured and swollen. Any condition that causes swelling or a change in position of the tissue within the carpal tunnel can squeeze and irritate the median nerve. Irritation of the median nerve can cause tingling and numbness of the thumb, index and the middle fingers. It may not be a life threatening injury, but RSI has the potential to cause crippling disability and pain. Repetitive stress induced carpal tunnel strain is the leading cause of carpal tunnel syndrome in most industrialized countries. In the USA for instance, repetitive stress induced carpal tunnel syndrome is the biggest single contributory factor to lost time at work. This type of carpal tunnel syndrome results in billions of dollars of workers compensation claims every year.

Ergonomics is the study of optimizing the interface between human beings, and the designed objects and environments they interact with. As describe in the applicants invention, the Ergonomic Pipette Tip shows the upper portion of the elongated tubular receptacle or member having a central axis and receiving cavity made usually from a rigid material such as but not limited to polypropylene. The upper portion being constructed for mating with a pipetter barrel having an inwardly facing surface defining the receiving cavity and a sealing member including an annular sealing ring protrusion coupled to the inward facing surface of the receiving cavity in a perpendicular relation to the central axis. The sealing member including an annual matting sealing ring protrusion is made from an elastomer that can be constructed from materials such as but not limited to SANOPRENE, which a thermoplastic elastomer (TPE) made by alloying polypropylene (PP) with ethylene (EPDM) by Advanced Elastomer Systems materials or KRAYTON by Shell. Other elastomeric materials selected from the groups consisting of thermoplastic elastomers (TPE), thermoplastic vulcanizates (TPV), thermoset elastomers, thermoplastic rubbers, elastoplastics, silicones, saturated and unsaturated rubbers are also materials of choice for the sealing member. The sealing member being constructed with a protrusion is engineered to increase the sealing effectiveness of the new ergonomic pipette tip while reducing the friction between the mating parts. These materials are soft and elastic and can include additives such as but not limited to Teflon to increase the lubricity of the material while lowering the coefficient of friction between the matting parts. These elastomeric materials normally have a durometer hardness rating from 30-90 Shore A compared to the much harder and rigid polypropylene material, with a durometer 75 Shore D, which forms the elongated tubular member of the pipette tip.

The sealing member being constructed from these rubber-like materials is very resilient and has a memory to be dimensional controlled and is capable to be insert or over-molded over the more rigid elongated tubular receptacle as previously discussed. This process is necessary to create a consistent and reproducible sealing surface within the tubular member or receptacle. The convex, arched or bead-like annular sealing surface protrusion of the sealing member is able to adjust to the pipetter barrel with greater interference or squeeze but with less friction than prior art pipette tips. The flexibility to increase the sealing capability or interference of the pipette tip while yet decreasing the friction between the parts and thus reducing the axial forces require to install and eject the pipette tip from the pipetter is of the utmost importance in creating this new ergonomic pipette tip. This can only be accomplished because of the engineering design of the minimal contact surface area of the protrusion or protrusions and the lower durometer elastomeric sealing material used in the sealing protrusions that make up the sealing member. This combination allows for greater squeeze with less friction than that of the more rigid material and larger sealing surfaces used in the past.

One embodiment as shown in FIG. 2 illustrates the pipetter barrel 48 inserted to a predetermined depth 95 that insures that the bottom surface 47 of ejector sleeve 45 is touching the top surface 43 of the upper portion 42 of the pipette tip while maintaining a perpendicular sealing axis 75 to the central axis 100 of the pipette tip. The distal end 30 of the pipetter barrel 48 is inserted to a predetermined depth that defines the inward facing lateral support surface 73 of the receiving cavity 90 as substantially equal to the lowermost portion 74 of sealing surface 49 of the pipetter barrel 48 providing a support surface or zone to prevent lateral movement or rocking of the new ergonomic pipette tip 55 about its central axis 100. Because the sealing of the pipetter barrel is engineered from a secondary elastomeric sealing member 99 shown as the o-ring type sealing protrusion 65, the lowermost portion 74 of pipetter barrel 48 may contact the lateral support inner surface 73 of the more rigid material forming the upper portion 42 of the pipette tip but need not make a seal which would result in an undesirable increase in the axial forces to install and eject the pipette tip from the pipetter barrel. This structural configuration provides the elasticity for the sealing member 99 to make the seal over a much wider range of dimensional sizes and tolerances than that of the one material pipette tips. In addition the combination of the elastomeric sealing contact surface 64 of sealing protrusion 65 with the rigid lateral support surface 74 prevents transverse rocking of the new ergonomic pipette tip on the pipetter barrel as might occur during touching off of the pipette tip and the accompanying undesired dislodging of the tip from the pipetter barrel.

As shown in another embodiment FIG. 3, the frustum shaped receiving cavity 90 of the pipette tip 55 includes a mechanical stop 92 preferably a ledge or a rib that is perpendicular to the central axis 100 of the pipette tip to limit the insertion depth 95 of the distal end 30 of the pipetter barrel 48 into the receiving cavity 90 of the pipette tip. These small ribs, stops or ledge 92 provide close tolerance control over the insertion depth 95 of the pipetter barrel 48 into the receiving cavity 90. This insures consistent control of the diametrical fit between the lowermost portion 74 of the sealing surface 49 adjacent the distal end 30 of the pipetter barrel 48 and inside surface of the lateral support zone 73 of the receiving cavity 90 just above the mechanical stop 92 to insure lateral support for the pipetter barrel. Further it provides means to insure uniform interference or squeeze between the pipetter barrel sealing surface 49 and the annular sealing protrusion 65 as successive tips are mounted and ejected from the pipetter barrel 48. Only by controlling the depth of entry 95 in cooperation with the predetermined resilient diametrical interference of the elastomeric sealing protrusion 65 and lateral supports 73 can we create consistent hermetic seals with each pipette tip barrel insertion and control the axial forces required to install and eject these new pipette tips from the pipetter.

Further, the preferred embodiment of the present invention includes an elastomeric sealing region constructed with a controlled increased interference or squeeze onto the inserted pipetter barrel sealing surface 49 providing less friction and a better air tight sealing capability than has been previously available in the marketplace. In addition the matting annular lateral support zone 73 as well as cooperative means on the pipetter barrel 48 for limiting the axial travel of the pipetter barrel insures uniform depth of penetration 95 into the receiving cavity 90 of the new ergonomic pipette tip 55. All of this while maintaining the squeeze or seal interference between the annular sealing zone created by the sealing member's protrusions 65 and the pipetter barrel sealing surface 49 to minimize the axial forces to install and eject the pipette tip from the pipetter.

In addition, the elastomeric sealing material may also be constructed to mate with the outside or top surface of the pipette tip as shown in other embodiments. In normal pipette tip production the adding of colorant to the plastic is prohibited due to the contamination that can occur between the sample and the colorant. This is why only virgin materials are used in the production of almost all pipette tips. If colorant is used it would only be use in very small amounts to limit the potential problems that can occur though leaching of the colorant into the fluid sample. Because the new ergonomic pipette tip provides a separate sealing member 99 constructed from an elastomer that does not contact any fluid sample, the sealing member 99 can be colored with high concentrations of colorant without the worry of fluid sample contamination. This offers the manufacture the opportunity to color the new ergonomic pipette tips for particular applications, test or sample size.

Furthermore, disposable pipette tips are commonly mounted and stored in sterilized racks that include a support tray having an array of holes for receiving the distal ends of the tips while leaving the upper portion exposed for receiving the pipetter barrels onto which the pipette tips are mounted. In cases such as this, the upper portion of the tips as shown by the applicant's drawings is the only visible area able to be seen by the user. The ability to add a specific color or character to this upper portion insures the user has correctly chosen the specific tip for his or her application. For example, if a interior wall of a particular pipette tip had been pre-coated with a reagent or reactant 61 that was designed to mix with a particular volume incoming sample fluid 60, the pipette tip sealing member 99 could be of specific color or created with a character to signify to the user that he has chosen the correct pipette tip for his test or her test. This is also very important for volume related dispensing when specific tips are used on specific pipetters. These and other uses for the two material pipette tips will become very apparent as the detail of the invention is described.

It is another object of this invention to provide an ergonomic pipette tip with different dispensing tip configuration that allows access into smaller and deeper containers. One such embodiment allows the pipette tip to contact the bottom of the container or vial to maximize the amount of sample that is capable of removing from its container. This is of the utmost importance when valuable or limited samples are used. It also eliminates the problem of plugging the end of the tip as the sample is drawn and the orifice touches the bottom surface as with existing art. This not only limits the amount of sample that can be drawn but can compromise the accuracy and precision of the dispensed sample. This new invention is designed with an angled apex end or provides separate channels for the fluid to flow through when the ergonomic pipette tip contacts any surface. This concept is especially beneficial in use with multi-pipetters and automating equipment when the user or the machine can be designed to touch the bottom surface of its container to insure that the entire valuable sample is removed and dispensed.

It is another object of this invention to provide an ergonomic pipette tip, which contains a tube or needle attached to its apex end. In one embodiment the tube or needle would be use for puncturing or accessing very small container and transferring limited amounts of fluid.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION OF INVENTION

Figure 1:
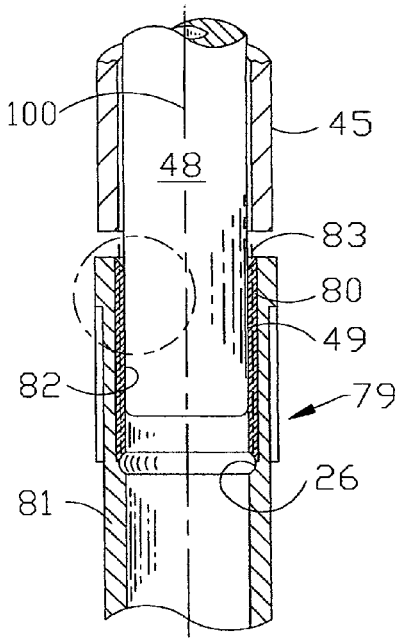
FIG. 1 PRIOR ART
FIG. 1 is the cross section of a prior art U.S. Pat. No. 5,660,797 with a pipetter barrel installed. The elongated sealing collar constructed from a softer material surrounds the mating pipetter barrel promoting sealing but increasing the frictional interference between the two mating parts creating a high coefficient of friction. The static or breakaway friction of theses two dissimilar materials in combination with the increased surface area of the mating surfaces requires substantially greater axial forces to eject this pipette tip from the pipetter barrel than prior art configurations.
Figure 1A:
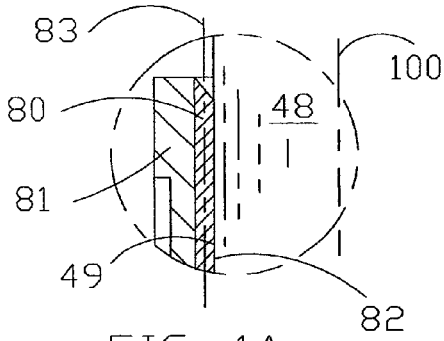
FIG. 1A PRIOR ART
FIG. 1A is an exploded detail view of FIG. 1. The axis of the elongated inner collar is shown as being longitudinal or parallel in relationship to the longitudinal axis of the pipetter barrel and pipette tip. The large surface contact area between the pipetter barrel sealing surface and that of the inner collar which promotes the sealing of this pipette tip is also longitudinal in nature which causes increases surface friction between the two parts during the installation and ejection cycles.

FIG. 1 and FIG. 1A illustrates a cross section and detail of a prior art U.S. Pat. No. 5,660,797 that includes a two material pipette tip 79 with a pipetter barrel 48 installed for illustration and discussion purposes only. The top end of the tubular member 81 includes an elongated sealing collar 80 that is constructed of a secondary softer material than that of the tubular member 81. The inner collar 80 includes an inner surface 82 that surrounds and engages the mating sealing surface 49 of the pipetter barrel 48 as it enters the uppermost portion of the pipette tip 79. The axis 83 of the elongated inner collar 80 is shown as being longitudinal or parallel in relationship to the longitudinal axis 100 of the pipetter barrel 48 and pipette tip 79. As shown, the large surface contact area between the pipetter barrel sealing surface 49 and that of the soft inner surface 82 of the sealing collar 80 which promotes the sealing of this pipette tip is also longitudinal. These substantially parallel surfaces create a very large surface contact area between these two mating parts similar to prior art tips to insure the sealing capability of the two mating parts. However, the very large surface area of the two mating parts created by this sealing method increases the surface friction between the two parts during the installation and ejection cycles of this type of pipette tip with the barrel 48 of the pipetter.

As stated, the elongated sealing collar 80 promotes sealing but also increasing the frictional interference between the two mating surfaces 49 and 82 creating a high coefficient of friction. Friction is the resistance to motion which takes place when one body is moved upon another, that force which acts between the two surfaces at their surface of contact is the axial force needed by the ejector sleeve 45 of the pipetter to overcome this resistance to eject the pipette tip 81 from the pipetter barrel 48. The static or breakaway friction of theses two dissimilar materials in combination with the increased surface area of the mating surfaces requires substantially greater axial forces to eject this pipette tip 79 from the pipetter barrel 48 than prior art configurations.

In addition, most existing pipetters have pipetter barrels that are engineered with a 2.0 to 3.0 degree included angled taper. This helps to insure that the mating surfaces of the tapered pipette tip creates a large frustoconical sealing area between the two parts. Since most pipette tips are constructed form a rigid polypropylene material, the wedge effect for removal of the pipette tip from the pipetter barrel as previously discussed can be as high as 18-25 pounds causing potential injury to the user over time.

In the prior art example of FIG. 1, there is no mechanical stop shown or described in the body of the patent to limit the downward penetration of the pipette barrel 48 into the receiving cavity of the pipette tip 81. This is understandable since prior art pipette tips over the past 30 years are constructed in this same manner. Therefore the user is not limited and can easy increase the amount of downward insertion force he or she can exert in the installation of the pipetter barrel 48 into pipette tip 79 to further increase the sealing effectiveness of the pipette tip installation.

The undercut shown as a recess 26 in the tubular member 82 is not a mechanical stop to limit the penetration of the pipette barrel 48. First it does not protrude inwardly and second it has a special tooling purpose. The recess or undercut in the tubular member 82 is formed by a protrusion on the steel core that produces the inside configuration of the plastic pipette tip. This undercut or undercuts are very common in the production of these plastic pipette tips since the draft angles of these parts are minimal. The undercut or recess 26 as with most every other pipette tip in production is used for the purpose of insuring that the plastic pipette tip stays on the core side of the injection mold tooling when the cavity side of the ejection tool is withdrawn or opened after the plastic has cooled. After the cavity side is opened, the ejector plate is actuated and the plastic pipette tip is stripped from the core. The mold will then close and another cycle will begin. Without this undercut in the plastic part, the plastic pipette tip can easily be removed from the core and get stuck into the cavity side of the injection mold during the manufacturing process. This stops production and can cause harm to the steel tooling producing these parts. This undercut is essentially to insure these parts stay on the core side during the ejection molding process.

Furthermore, because there is no mechanical stop or means to limit the penetration of the barrel 48 into the receiving cavity as shown of FIG. 1, a similar wedge effect as described with the one material pipette polypropylene tips will occur. The difference being that the interference between the large rigid frustroconical sealing surface 49 of the pipetter barrel 48 and the softer sealing surface 82 of the elongated sealing collar 80 can be substantially increased due to the elastic properties of the softer polymer. The rigid pipetter sealing surface 49 of the pipetter barrel 48 can further depress the softer material whereby forming an additional squeeze creating the desired seal between the two parts. This sealing effort in conjunction with the large surface area creating the design of the sealing collar can cause a locking effect onto the sealing surface 49 of the pipetter barrel 48. This additional squeeze of the large frustroconical contact surface area of the softer material can further increase the coefficient of friction between the mating parts, thus increasing the axial ejection forces require to overcome the breakaway friction between these two dissimilar materials. Therefore, even though the softer material as shown in FIG. 1 may promote the sealing effectiveness of the pipette tip shown in FIG. 1, it has not been engineered to decrease the amount of axial force necessary to install and eject the pipette tip from its pipetter barrel as my new invention embodiments will be shown to do.

Figure 2:
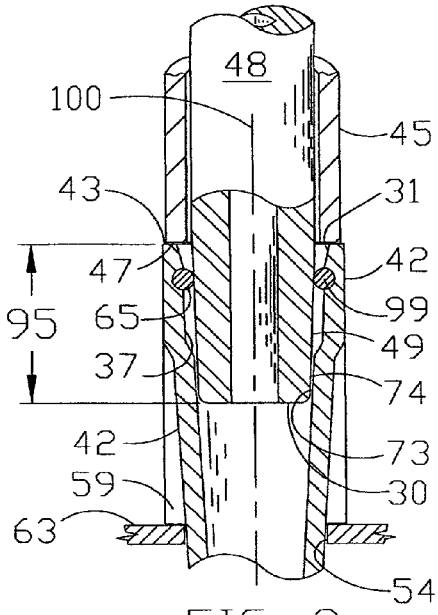
FIG. 2 is a fragmented cross section of a new two material pipette tip with a pipetter barrel installed and the tip ejector mechanism of the pipetter adjacent the top surface limiting the pipetters barrel penetration into the receiving cavity. The sealing member includes an arched shaped sealing protrusion whose axis is perpendicular to the longitudinal axis of the tubular member and constructed from an elastomer. The elongated tubular member is constructed from a rigid chemically inert material and provides for fluid containment as well as providing a lateral support region to the pipetter barrel.
Figure 3:
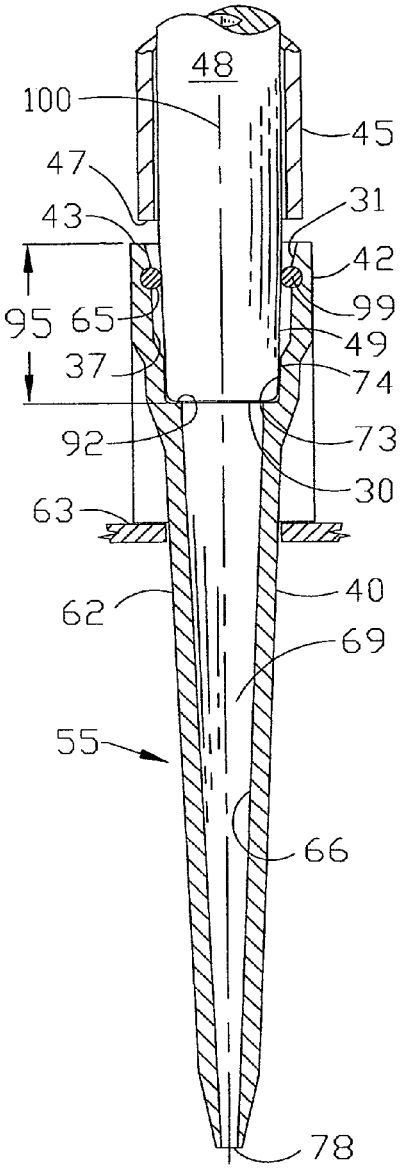
FIG. 3 is a cross section of a two material pipette tip with a pipetter barrel installed. The sealing member with protrusion is constructed from an elastomer while the elongated tubular member of the pipette tip is constructed from a rigid material that provides a lateral support region and a shoulder or stop to the distal end of pipetter barrel providing cooperative means to limit the penetration of the pipetter barrel into the receiving cavity of the pipette tip.
Figure 14A:
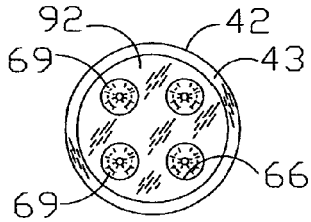
FIG. 14A is a cross section as illustrated by the arrows depicted in FIG. 14 showing the top view into the receiving cavity of the upper portion of the new multi-pipette tip. The lower section in this illustration is constructed with 4 conical lower portions and with 4 apex ends for use in multiple dispensing without the need of a multi-barrel pipetter. It is understood that this configuration can be constructed with any combination of lower portions including but not limited to 2, 4, 6 or 8.
Figure 14:
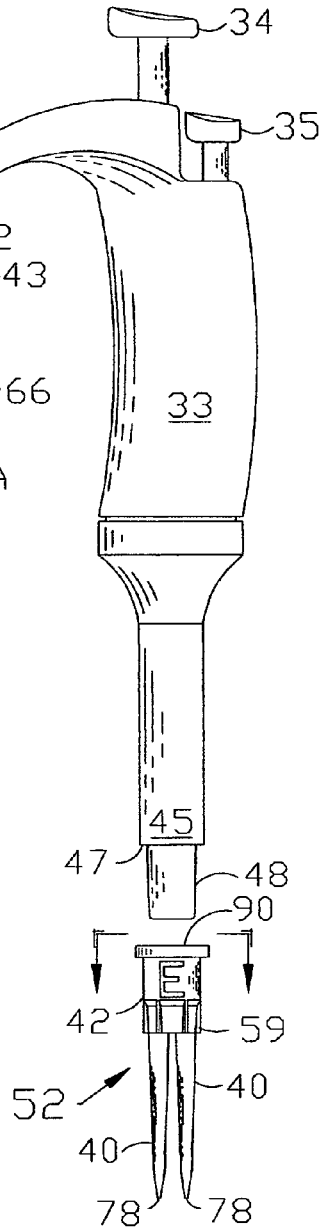
FIG. 14 illustrates a standard use pipetter ready to be installed into an upper portion of a new multi-pipette tip. In this new embodiment, the one upper portion can be constructed similar to the upper portions previously described in FIGS. 2-12 including but limited to the addition of the sealing member as previously discussed. The bottom section of this new multi-tip contains multiples of the already described lower portion with apex ends including at least two lower portions in communication with one upper portion providing for multiple aspirations and dispensing from a new single mount ergonomic pipette tip.

FIGS. 2-3 illustrate a cut away cross section of a lower portion of a standard air displacement pipetter sealingly attached to a new and improved ergonomic pipette tip 55. The lower section of the standard pipetter 33 (as shown in FIG. 14) consists of a pipetter barrel 48 with distal end 30 and an ejector sleeve 45 with a central axis 100 which is operated by the ejector mechanism and button 35 to eject the disposable pipette tip 55 from the pipetter barrel 48 after each use to limit contamination between samples.

The new and improved ergonomic pipette tip 55 can be manufactured with two parts each having a different material, each material having a specific function and use. The elongated tubular member 62 with apex end 78 can be molded or formed from a multitude of different polymers or materials depending on the specific fluid or sample that it must transport for the test or evaluation it must perform. The elongated tubular member 62 includes an inside tip cavity 69 for containing the sample fluid 60 drawn through the apex end 78 when the pipetter aspirates a fluid sample for transporting and delivering to another site. The majority of the existing pipette tips are molded from a virgin polypropylene material, which is satisfactory for most applications. However the need does arise for some applications that require better chemical, temperature, strength, hardness, clarity, sterilization and or other properties that existing pipette tips do not have. Taking into account the many variables that may exist in selecting a particular material for a particular application; this improved two material ergonomic pipette tip gives you this capability. Materials selected from the groups consisting of thermoplastics, thermoset plastics, fluorocarbon plastics, metal, steel and even glass would be available if so desired. Material such as, but not limited to, chemically inert TEFLON, (PFA, FEP) tefzel, polyetheretherketone (PEEK), aurum, polycarbonate, acrylic, polystyrene and standard polypropylene are a few of the plastic materials of choice for the elongated tubular member 62 of this new pipette tip. Glass fibers or other fillers may also be added to the plastic to increase its structural or chemical strength without the worry or need to insure that the material be resilient enough to make a seal with the pipetter barrel 48 as is with existing pipette tips in the marketplace. This is due to the new ergonomic design that divides the ergonomic pipette tip 55 into two parts, a sealing member 99 and the elongated tubular member 62, each having its on function and its own material.

Figure 2A:
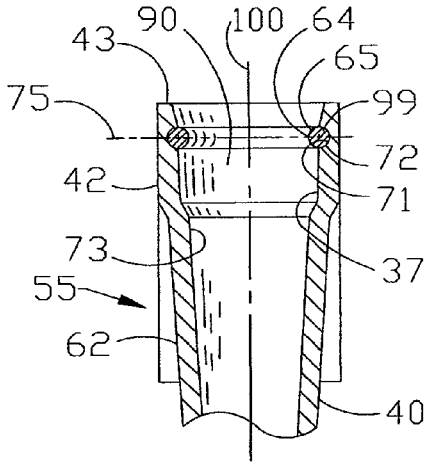
FIG. 2A is a fragmented cross section of the pipette tip shown in FIG. 2 with the pipetter barrel removed showing the sealing member with a sealing protrusion having a center line or axis being perpendicular to the central axis of the elongated tubular member forming the pipette tip.

FIG. 2 and FIG. 2A show the elongated tubular member 62 having a central axis 100 with an upper portion 42 having an inwardly facing surface 37 defining a central receiving cavity 90 providing a surface for the sealing member 99 to be coupled or attached hermetically and sized for receiving the sealing surface 49 of the pipetter barrel 48. The inward facing surface 37 has an inward facing surface configuration 71 being adapted to mate and be hermetically attached to the outside matting surface 72 of the sealing protrusion 65 of the sealing member 99 to insure an air-tight joint. It is understood the surface configuration 37 may be a recess in the elongated tubular member 62 as shown in FIG. 2-3 but also can be constructed with other surface variations including but not limited to a flat surface if so desired.

The axis 75 of the sealing ring protrusion 65 is perpendicular to the central axis 100 and its sealing contact surface 64 is engineered to make contact and seal with the sealing surface 49 of pipetter barrel 48 upon penetration into the receiving cavity 90. The sealing member 99 with protrusion 65 is illustrated as a torus or convex arched-shaped O-ring type configuration, however, other sealing design cross-sections such as but not limited to a parabolic design would also work. The sealing member 99 can be molded or constructed from a more elastic or resilient material than that of the elongated tubular member 62 thus increasing the sealing effectiveness of the sealing area. The sealing member 99 can be constructed from materials such as but not limited to SANTOPRENE which is a thermoplastic elastomer (TPE) made by alloying polypropylene (PP) with ethylene propylene (EPDM) by Advanced Elastomer Systems or KRAYTON by Shell are a few of the materials of choice for sealing member 99. Other materials selected from the groups consisting of thermoplastic elastomers, thermoset elastomers, thermoplastic rubbers, thermoset rubbers, elastoplastics and silicones are also available for choice. Lubricants such as but not limited to TEFLON can also be added to these materials to add lubricity while also helping in lowering the coefficient of friction between the sealing member 99 and pipetter barrel 49. These materials are soft and normally have a durometer hardness rating from 30-90 Shore A compared to the much harder and less flexible polypropylene material with a Durometer 75 Shore D.

Pipette tips are commonly mounted and kept in sterilized racks for installation purposes and storage. Such racks include a support tray surface 63 with an array of loosely fitting holes 54 that are usually but not limited to a 12×8 matrix or 96 openings for receiving the distal ends of the pipette tips 55. The upper portion 42 of the pipette tip 55 includes axial spaced support ribs 59 that insure vertical orientation of the pipette tip 55 to the support tray surface 63. The support ribs 59 also act as a stop and prevent the pipette tip 55 from being pushed into the opening 54 when the pipette tip 55 is installed onto the pipetter barrel 48.

Under normal procedure the pipette tip is resting on the support tray surface 63 as shown in FIG. 2-3 with the receiving cavity 90 facing upwards. The pipetter barrel 48 includes a frustroconical sealing surface 49 and a distal end 30, which is guided by the uppermost guide surface 31 of the upper portion 42 to mate with the sealing protrusion 65 of sealing member 99. As the pipetter barrel 48 penetrates the receiving cavity 90, the inwardly facing sealing protrusion 65 includes a sealing contact surface 64 which is convex or arched in shape for this embodiment. It is understood that other configurations are adaptable to this invention including but not limited to a V-shape or a V-shape with a small flat top but in all cases a minimal contact surface area is desired to reduce the coefficient of friction between the sealing member 99 and pipetter barrel 49. As the sealing surface 49 of the pipetter barrel 48 contacts and expands the elastomeric sealing contact surface 64 of sealing protrusion 65, the sealing surface 64 forms a hermetic seal with a controlled interference fit between the pipetter barrel 48 and the two part, two material pipette tip 55. It is understood that only the elastomeric surface 64 of the sealing protrusion 65 is compressed with minimal force creating a sealing surface that minimizes the friction characteristics of the assembly. At no time does the elongated tubular member 62 expand or make a seal with the pipetter barrel 48 as in prior art configurations.

Furthermore, to create additional lateral support for the pipette tip 55 and prevent any possible transverse rocking of the pipette tip 55 during the fluid transfer procedure, the lowermost portion of the receiving cavity 90 is constructed with an inwardly facing lateral support surface or surfaces 73 which is defined as a lateral support zone or support region created by at least one surface that is slightly less than or equal to the lowermost frustroconical portion 74 of sealing surface 49 adjacent the distal end 30 of the pipetter barrel 48 as shown in FIG. 2 and FIG. 3. This allows for minimal contact between the lowermost portion 74 of the pipetter barrel 48 and the lateral support surface 73 of the elongated tubular member 62 without creating a secondary seal or interference that would require additional axial force to overcome when the pipette tip 55 was ejected from the pipetter. It is also understood that the pipetter barrel 48 could be cylindrical in shape or contain a lowermost annular protrusion and still function in the same manner as describe above.

Again, in this embodiment the bottom edge 47 of the ejector sleeve 45 limits the axial predetermine penetration insertion depth 95 of the pipetter barrel 48 into the receiving cavity 90 and thus maintains uniform sealing interference between the frustroconical sealing surface 49 of the pipetter barrel and the softer sealing contact surface 64 of the protrusion 65 as successive tips are mounted on and ejected from the pipetter barrel 48. This dimensional cooperation between these two parts insures that both the sealing interference and axial depth of penetration of the pipetter barrel into the receiving cavity are consistent between multiple parts. This cooperation provides the necessary engineering parameters to reduce the breakaway friction between these two parts to less than three and preferably below one pound to reduce the hand and thumb forces required during the repeated mounting and ejection of these new ergonomic tips.

As illustrated in FIG. 3, the upper portion 42 is a variation of the embodiment as shown in FIGS. 2 and 2A. The upper portion 42 of the new embodiment includes an inside perimeter ledge 92 oriented generally perpendicular to the longitudinal axis 100 of the elongated tip 55. The perimeter ledge 92 is formed at the lowermost lateral support surface 73 providing a stop to the axial penetration of pipetter barrel 48 by contacting the distal end 30 of the pipetter barrel 48. This occurs at a predetermined insertion depth 95 to insure the correct diametrical interference between the sealing surface 49 of the pipetter barrel 48 and the sealing contact surface 64 of the sealing protrusion 65 have been met to insure that the axial force is preferably less than one pound force for installation and ejection of these new ergonomic pipette tips.

Unlike the FIG. 2 embodiment, the bottom surface 47 of ejector sleeve 45 shown in FIG. 3 does not come in contact with the top surface 43 of the upper portion 42. Without this stabilizing feature the necessity for the lateral support surface 73 in cooperation with the inside perimeter ledge 92 becomes very important to insure stability during the installation and use of the ergonomic pipette tip. This cooperation orients and insures that the pipetter barrel 48 is co-axial with the ergonomic pipette tip 55 and prevents any traverse rocking to occur while creating the predetermined interference or squeeze to reduce the break away friction associated with tip removal.

Figure 3A:
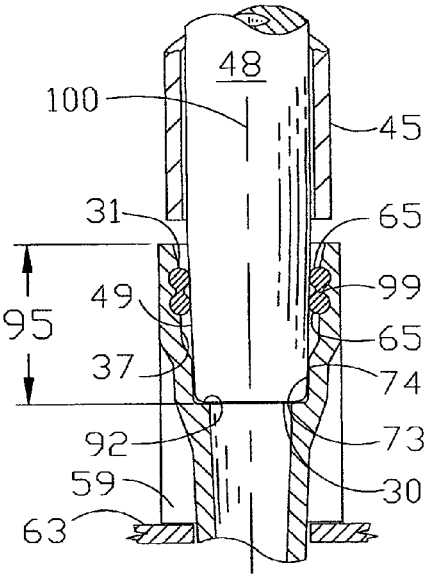
FIG. 3A is a fragmented cross section of a two material pipette tip with a pipetter barrel installed. A sealing member constructed with an elastomeric two-lobe sealing protrusion is shown. The elongated tubular tip is constructed from a rigid material that provides a lateral support zone and a shoulder or stop to the distal end of the pipetter barrel providing corporative means to limit the penetration of the pipetter barrel into the receiving cavity of the pipette tip.
Figure 3B:
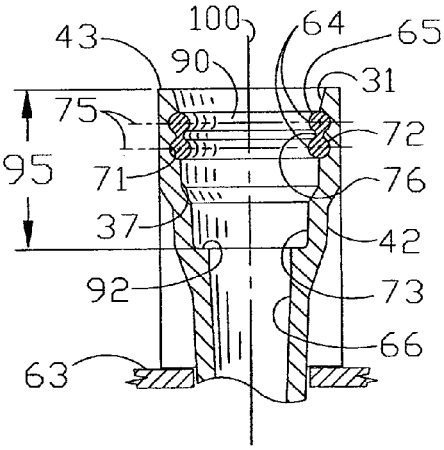
FIG. 3B is a fragmented cross section of the two material pipette tip shown in FIG. 3A with the pipetter removed. The sealing member illustrating the two sealing ring protrusions are each shown having a central axis that is perpendicular to that of the central axis of the elongated tubular tip.

FIGS. 3A and 3B show an embodiment similar to that of FIG. 3, further including the use of sealing member 99 with 2 sealing protrusions 65 instead of one. The elongated tubular member 62 having a central axis 100 with an upper portion 42 having an inwardly facing surface 37 defining a central receiving cavity 90 providing a surface for the sealing member 99 to be coupled or attached hermetically and sized for receiving the barrel 48 of the pipetter. The inward facing surface 37 has a surface configuration 71 being adapted to mate and be hermetically attached to the outside matting surface 72 of sealing member 99 to insure an air-tight joint. It is understood the surface configuration 72 may be a recess in the elongated tubular member 62 as shown in FIGS. 3A and 3B but also can be constructed with other variations including but not limited to a flat or cylindrical surface if so desired.

The first or upper and the second or lower sealing protrusions 65 are disposed inwardly in generally perpendicular relation to the central axis 100 of the pipette tip 55 as shown by the axis 75 through which the convex or arched radius surfaces are formed. The inward sealing contact surface 64 of the first or upper sealing protrusion 65 is an arched shaped configuration. The second or lower sealing protrusion 65 is also arched shaped with a concave arched shaped recess 76 between the 2 convex arched shaped sealing surfaces 64. The 2-lobed sealing design provides twice the sealing surface as the single version as shown in FIG. 3. The double-seal design not only provides for lower friction than the single o-ring type configuration but provides more lateral support of the mating parts upon assembly. Twice the sealing surface also means less radial squeeze is needed to create an effective seal resulting in less friction and thus less axial forces required to install and remove the pipetter barrel 48 from the new ergonomic pipette tip 55 as shown in FIG. 3A. It is also understood that the two or more protrusions 65 including the annular sealing surfaces 64 maybe further apart and connected with other recess configurations, including but not limited to flat or cylindrical. It is also understood that the 2 or more sealing protrusions 65 constructed from an elastomer maybe independently formed in the upper portion 42 and not be connected without deviation from the intentions of this invention.

Lateral support zone for the pipetter barrel 48 is also shown in FIGS. 3A and 3B as surface 73 of the receiving cavity 90 provides minimal contact between it and the lowermost portion 74 of the pipetter barrel as shown and described in previous embodiments. Be it known that if the first or upper sealing protrusion 65 and second or lower sealing protrusions 65 were further apart than the illustration, the sealing surfaces 64 of the two protrusions 65 would help provide additional lateral support to the sealing surface 49 of the pipetter barrel 48. It is also understood that if the second or lower sealing protrusions 65 was constructed at the proximate location of the lateral support surface 73 of the upper portion 42, the sealing surfaces 64 of the second or lower sealing protrusions 65 would provide not only the sealing but also the lateral support to the sealing surface 49 of the pipetter barrel 48 keeping the two matting parts co-axial and thus eliminating the need for lateral support surface 73 in the embodiment described but not shown.

Another benefit of the two parts, two material ergonomic pipette tip 55 is that a colorant can be added to the non-fluid contact sealing member 99. This allows the manufacture to color-code the pipette tips for a particular size, volume, chemical resistance or specific test they can perform. Color would be limited to the upper portion 42 since most fluid contact areas such as lower portion 40 of the elongated tubular member 62 require virgin plastic material with little or no colorant. This is due to potential leaching of the colorant or any additives in the plastic material that can migrate into the sample fluid 60 from the plastic, which can contaminate the sample and skew the sample results.

Figure 4A:
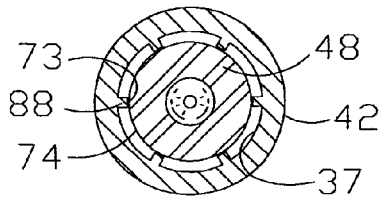
FIG. 4A is a cross section of FIG. 4 as designated by the section arrows shown through the lateral support region of the pipetter barrel including small locating ribs of the elongated tubular member created to prevent rocking and insure the central axis of the pipette tip and pipetter barrel are the same.
Figure 4:
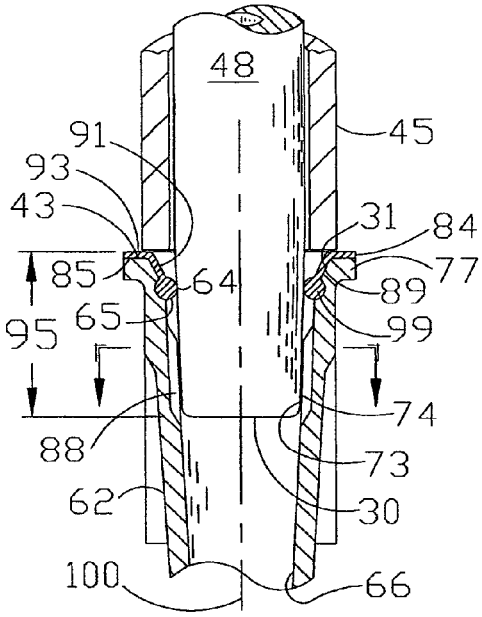
FIG. 4 is a fragmented cross section of a two material pipette tip with a pipetter barrel installed and the tip ejector mechanism of the pipetter adjacent the top surface of the pipette tip providing cooperative means to limit the penetration of the pipetter barrel into the receiving cavity of the pipette tip. The sealing member includes a sealing protrusion and a top surface that is constructed from an elastomer that can be colored for identification purposes. The elongated tubular member of the tip is constructed from a rigid material that provides a lateral support zone that includes small locating ribs for providing lateral support of the pipetter barrel.

FIGS. 4 and 4A show a variation of the single sealing ring protrusion embodiment as shown in FIGS. 2 and 2A with the sealing member 99 being constructed to cover the top surface of the entrance to the receiving cavity 90 of the new ergonomic pipette tip 55. With the addition of a colored material in this area, the user would be aware of the parameters, as indicated by a specific color, of the new ergonomic pipette tip 55 prior to the installation of the pipette tip 55 onto the pipetter barrel 48.

The upper portion 42 of FIG. 4 shows an upper edge portion 77 of upper portion 42 that includes a top face surface 43 generally disposed perpendicular to the central longitudinal axis 100 of the pipette tip 55. The upper or first sealing ring protrusion 65 includes the lead-in guide surface 91 and elastomeric outside flange portion 84 with a elastomeric bottom face 85 coupled to the top face 43 of the upper edge portion 77 forming a joint there between. It is also understood that one or more elastomeric sealing members including protrusions 65 may be constructed independently from the elastomeric outside flange portion 84 without deviating from the scope of this invention.

The embodiment of FIGS. 4 and 4A also includes lateral support surfaces 73 creating a lateral support zone which is constructed from 3 or more ribs 88 that are inward facing ribs formed from the inward facing surface 37 of the central receiving cavity 90. Unlike the substantially cylindrical surface as prior embodiments have shown, these small ribs 88 provide similar lateral support capability while reducing surface area contact which potentially insures less friction between the mating parts. As shown in the embodiment, the bottom surface 47 of ejector sleeve 45 has contacted the top surface 93 of the outside flanged portion 84 limiting the penetration of the pipetter barrel 48 into the receiving cavity. The predetermine penetration 95 of the pipetter barrel 48 has been made and the correct interference between the sealing surfaces 49 of the pipetter barrel and protrusion 65 have occurred. The pipette tip 55 is now supported, sealed and co-axial with the barrel of the pipetter.

Figure 5:
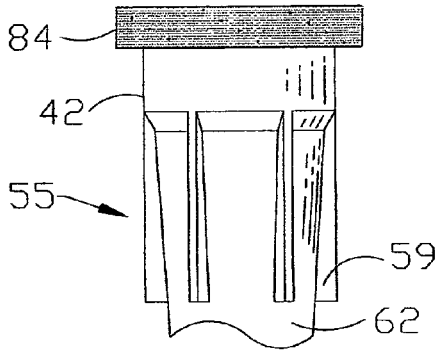
FIG. 5 is a fragmented side view of another embodiment including the elastomeric material of the sealing member shown over the top edge of the elongated tubular member of the pipette tip. The benefit being that the pipette tip can be colored in this area for identification.
Figure 5A:
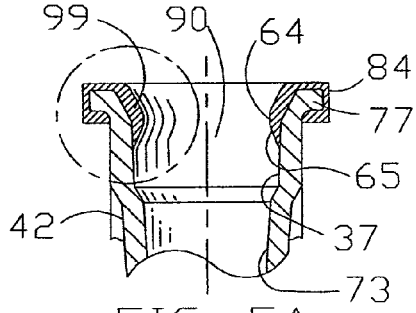
FIG. 5A is a cross section of the pipette tip as shown in FIG. 5 showing the elastomeric sealing protrusion of the sealing member as a ramp or v-shaped convex sealing bead protrusion coupled to the inside surface of the receiving cavity and upper flange portion of the elongated tubular member of the pipette tip.
Figure 5B:
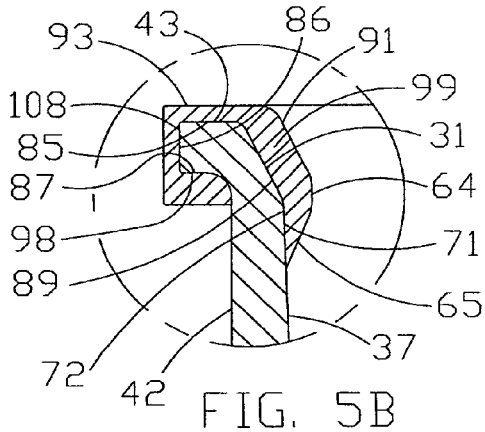
FIG. 5B is a enlarged detail of the upper corner portion of FIG. 5A showing the mating surfaces of the sealing member including the elastomeric outside flange portion and the sealing protrusion coupled to the upper flange portion and the inward facing surface of the receiving cavity of the of the elongated tubular member of the tip.

FIGS. 5, 5A and 5B illustrates a sealing member 99 including a more arched shaped elastomeric sealing surface 64 with an elastomeric lead-in surface 91 which acts as a guiding surface to the distal end 30 of pipetter barrel 48 as it enters the receiving cavity 90. The elastomeric lead-in surface 91 which is similar to FIG. 4 is usually between 20-90 degrees included angle or 10 to 45 degrees per side from the longitudinal central axis 100 of the pipette tip 55. The elastomeric back surface 89 of lead-in surface 91 is attached or coupled to the guide surface 31 of the upper portion 42 creating a hermetic joint between the two parts. In addition upper edge portion 77 includes an outward facing surface 108 disposed generally parallel to the central axis 100 and a bottom face 98 disposed generally perpendicular to the central axis 100. The elastomeric outside flange portion 84 includes an inward facing surface 86 coupled to the outward facing surface 108 of the upper edge portion 77 of upper portion 42. The upward facing elastomeric surface 87 is attached to the bottom face 98 of the upper edge portion 77 interlocking the elastomeric outside flange 84 to the upper edge portion 77 of the upper portion 42 of the elongated tubular member 62. It is understood that the pipetter tip 55 may not have an upper edge 77 but be constructed similar to FIG. 2 or 2A. In that case the elastomeric inward facing surface 86 would be coupled to the outside surface of the upper portion 42 without departing from the scope of this invention.

Figure 6:
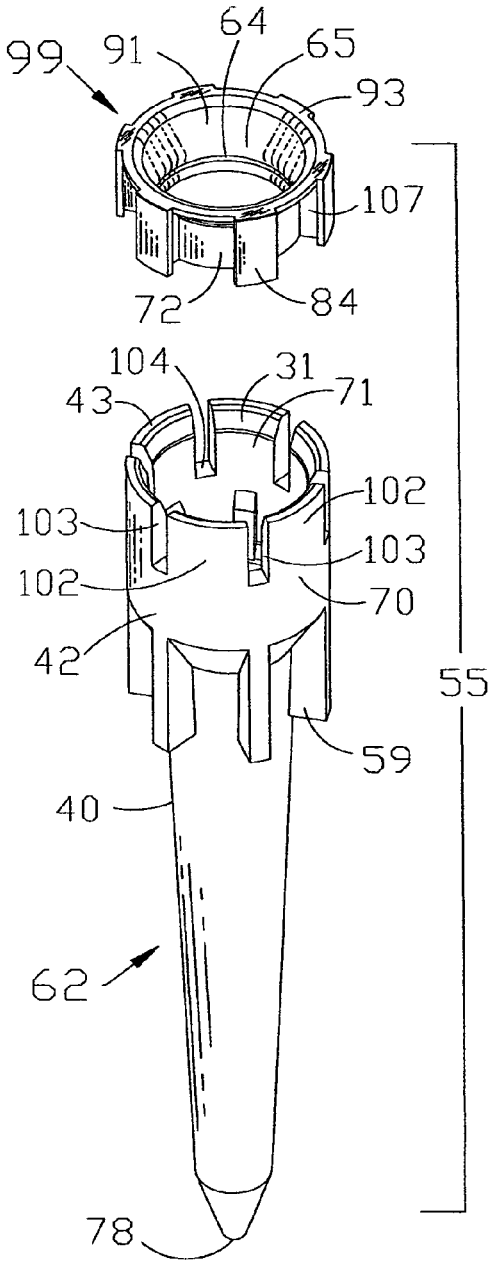
FIG. 6 is the exploded view of an embodiment of the two parts, two material pipette tip. The elastomeric sealing member is shown individually before being installed or molded into the receiving cavity of the elongated tubular member of the new ergonomic pipette tip. The axial slots shown in the upper portion of the elongated tubular member allow for orientation and attachment of the sealing member into the receiving cavity making a hermetic seal between the two parts.
Figure 6B:
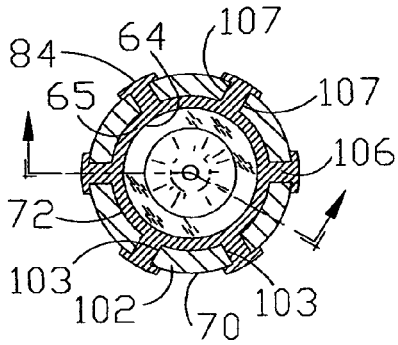
FIG. 6B is a cross section of FIG. 6A as designated by the section arrows shown through the sealing protrusion. The sealing member is molded providing axial ribs protruding and located into place through the axial slots of the elongated tubular member. These axial rib surfaces can be seen and provide the ability to designate a color scheme that may illustrate a particular test, application or volume the pipette tip can be used for. Six ribs are shown for illustration purposes only. It is also understood one or more of these ribs can be used.
Figure 6A:
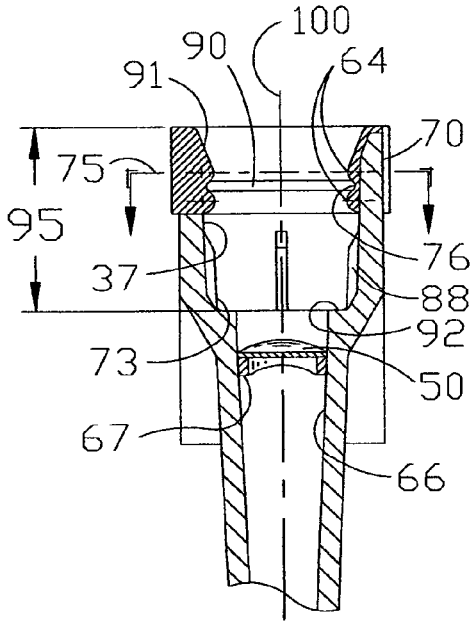
FIG. 6A is a fragmented cross section of the two material pipette tip as shown assembled in FIG. 6. The sealing member is constructed as a two-lobed design which provides lower friction with less squeeze and a lead-in ramp of entry. A lateral support zone is shown in the elongated tubular member with a shoulder or stop providing corporative means to limit the penetration of the pipetter barrel into the receiving cavity of the pipette tip. A membrane filter is also shown in the pipette tips lower cavity.

FIG. 6 shows a variation of the embodiments as shown in FIGS. 2,3,4 and 5 whereas the elastomeric sealing member 99 is shown separated prior to the installation into the tubular member 62 as shown in FIGS. 6A and 6B. The new ergonomic pipette tip assembly as shown and described in this invention will be fused to each other preferably by the two material insert injection or over-mold methods. For example, the tubular member 62 can be molded with a hard or rigid chemically inert material as mentioned previously in a first mold. The tubular member 62 can then be removed from the first injection mold and placed into a second injection mold. The second injection mold would be configured to form or create the sealing member portion 99 of the ergonomic tip 55. The sealing member 99 would be constructed using a secondary sealing material specifically engineered and previously described to seal with the barrel 48 of the pipetter. This elastomeric material provides better lubricity and sealing capability while lowering the axial insertion and ejection forces require to install and eject the new ergonomic pipette tip 55. This over-mold method as described above allows the two parts to be hermetically fused or bonded together in the mold creating a sterile one piece pipette tip assembly. This process can also be done at the same time in a two-shot injection molding press. It is also understood that the process can include three or more material shots without departing from the scope of this invention.

It is also understood that the sealing member 99 and tubular member 62 may also be assembled by fastening means selected from the groups consisting of heat, ultrasonic welding, RF welding, adhesive, mechanical snap, press fit, screw, staking or other means known in the arts. The intention of this invention is to bring the benefits of each of these two separate parts and their materials together in a hermetically bonded or fused one-piece ergonomic pipette tip assembly.

As illustrated in FIGS. 6,6A and 6B the upper portion 42 of the tubular member 62 has at least one axial spaced wall section 102 created in a first material having axial ends 103 in a circumferential direction about central axis 100. The axial spaced wall or wall sections 102 are formed by axial spaced ends 103 that form slots 104 in a vertical orientation coinciding with the central axis 100 of the elongated tubular member 62. The slots 104 are of predetermined width created by the distance between the axial ends 103 of axial walls 102 for mating with the axial ribs 106 of sealing member 99. The elastomeric sealing member 99 is constructed from a second material with at least one support rib 106 wall section sandwiched between the sealing ring protrusion 65 and a segmented outside flange portion 84 as shown in FIGS. 6A and 6B. The support rib 106 is constructed of axial spaced substantially parallel walls 107 that are coupled to the axial spaced ends 103 forming a joint between the axial spaced walls 102. The elastomeric rib 106 fused between the two axial spaced walls 102 can act as an elastomeric expansion joint for the circumstances that require larger radial expansion of the receiving cavity 90 that can't be accommodated by the deflection of sealing ring protrusion 65 alone. The rib 106 also provides the conduit to provide material flow between the sealing protrusion or protrusions 65 and the segmented outside flange 84 while providing structural integrity between the parts. It is also understood that a hole of any configuration between the inside surface 37 or 71 and the outside surface 70 of upper portion 42 can also act as a passageway or conduit to allow the elastomeric material to flow between the protrusion 65 and the flange portion 84 without departing from the scope of the invention.

FIG. 6A also defines a mechanical stop 92 with a predetermined pipetter barrel 48 insertion depth 95 as previously discussed for maintaining a uniform interference between the sealing member 99 and the pipetter barrel 48 as successive pipetter barrels are inserted and ejected from the new ergonomic pipette tip. In addition the use of optional lateral support ribs 88 with lateral support surfaces 73 as shown in FIGS. 4 and 4A is also disclosed for this embodiment. FIG. 6A also discloses a filter membrane 50 shown attached to a support ring 67 forming a hermetic seal between the ring 67 and the inside tip cavity surface 66 to insure sterile airflow through the filter membrane 50. The filter 50 could also be a plug type filter also known in the arts.

Figure 7:
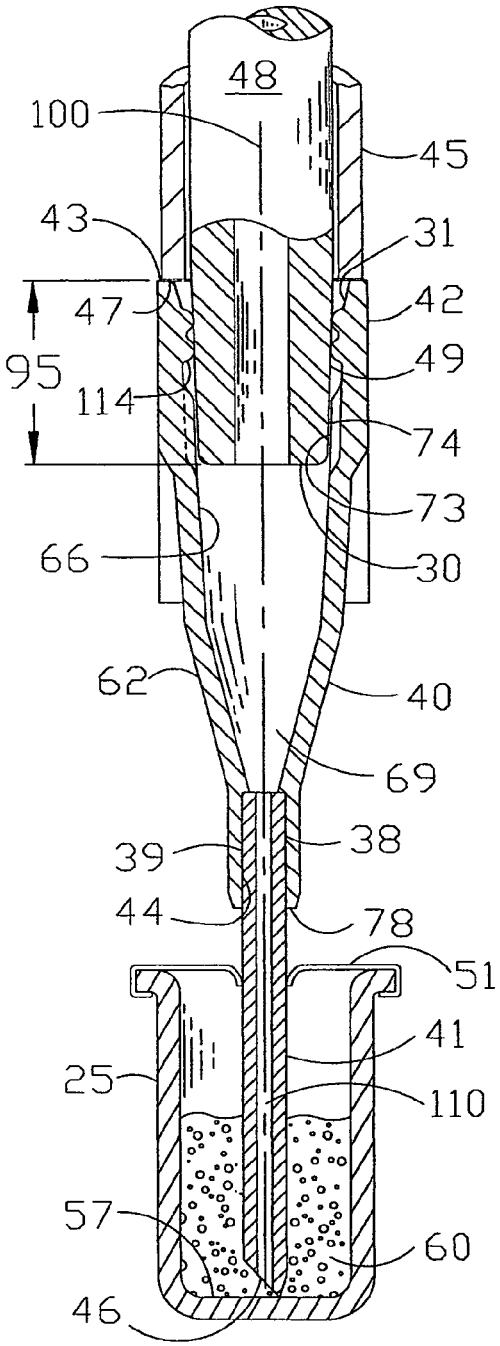
FIG. 7 is a cross section of a pipette tip with a pipetter barrel installed and the tip ejector mechanism of the pipetter adjacent the top surface of the pipette tip. The two lobed sealing protrusions provide twice the sealing surface which means less radial squeeze is needed for sealing the barrel resulting in less friction. A lateral support zone or region that includes small locating ribs for support of the pipetter barrel is also shown. In addition a secondary tube for accessing small openings or containers is hermetically sealed to the apex end of the elongated tubular member.
Figure 7B:
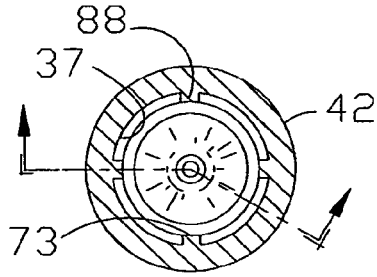
FIG. 7B is a cross section of FIG. 7A shown through the lateral support zone of the pipette tip as designated by the section arrows.
Figure 7A:
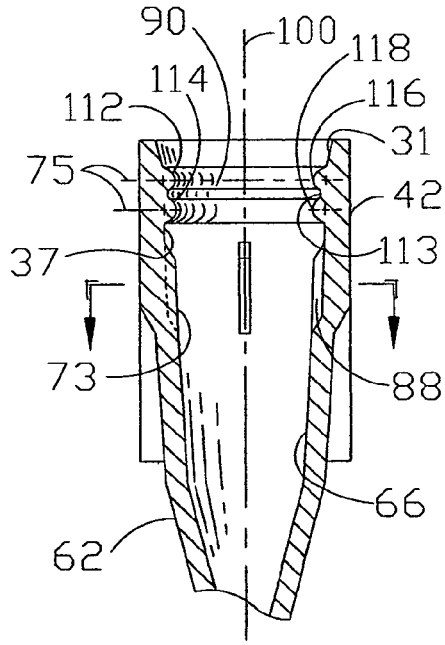
FIG. 7A is a fragmented cross section of the pipette tip shown in FIG. 7 with the pipetter barrel removed for clarity. The cross section taken is shown by the section arrows designated in FIG. 7B.

FIGS. 7,7A and 7B illustrates another embodiment which includes an elongated tubular member 62 with an upper portion 42 having an inwardly facing surface 37 defining a central receiving cavity 90. The inwardly facing surface 37 includes a two-lobed sealing surface for sealing engagement with the pipetter barrel sealing surface 49 of the pipetter barrel 48 inserted into the entrance of the receiving cavity 90. The first sealing ring protrusion 112 adjacent the entrance includes an arched shaped sealing surface 116 created through axis 75 which is perpendicular to the longitudinal axis 100 of the pipette tip. The second or lower sealing ring protrusion 114 is juxtaposed to the first sealing ring protrusion 112 including an arched shaped sealing surface 118 which is also disposed in a generally perpendicular relation to the central axis 100.

Between the first arched-shaped sealing surface 116 and the second arched-shaped sealing surface 118 there is an arched shaped recessed grove. This recessed grove 113 defines the distance between the two sealing surfaces 116 and 118 and is also generated through a perpendicular axis to the central axis 100. The two-lobed sealing design creates an alternative to the use of an elastomeric sealing member. The two sealing surfaces 116 and 118 adjacent one another gives a positive seal with less friction than a single sealing lobe. Twice the sealing surface means less radial squeeze is needed to create an effective seal resulting in less breakaway friction between the parts and thus reducing the axial forces needed to install and eject the pipette tip from the pipetter.

In addition to the two-lobed sealing, the upper portion 42 has been constructed to include lateral support ribs 88 with lateral support surfaces 73 as shown and discussed in FIGS. 4 and 4A. These lateral support surfaces 73 in the combination with controlling the insertion depth 95 and sealing interference of the sealing surfaces 116 and 118 onto the sealing surface 49 of the pipetter barrel 48 insure stabilization of central axis 100 of the tubular member 62 while maintaining pipette tip axial ejection forces below 3 pounds.

FIG. 7 also illustrates a tubular element 41 coupled to the apex end 78 of tubular member 62 forming a seal 38 between the outside surface 39 of the tubular element 41 and the inside sealing surface 44 adjacent the apex end 78 of the lower portion 40. The tubular element 41 has a long tunnel-shaped aperture 110 having a diameter substantially smaller than the average diameter of the inside tip cavity 69 of the lower portion 40 of tubular member 62. Tubular element 41 may be scaled to a very narrow dimension such as a needle. The small tube, needle or tubular element 41 can be constructed using high strength polymers, metal, steel or glass tubing. Its size is especially useful for accessing small deep containers or well plates while also offering the structural integrity of high strength material such as steel to puncture centrifuge caps 51 or other vials/containers that are usually accessed by syringes. In addition the apex end orifice 46 is angled preferably between 15 degrees to 60 degrees to allow for easier penetration while also preventing the orifice from plugging when the tubular element 41 contacts the bottom of the container 57, thus allowing the pipette tip to remove the entire sample fluid 60 from the container 25.

Figure 8:
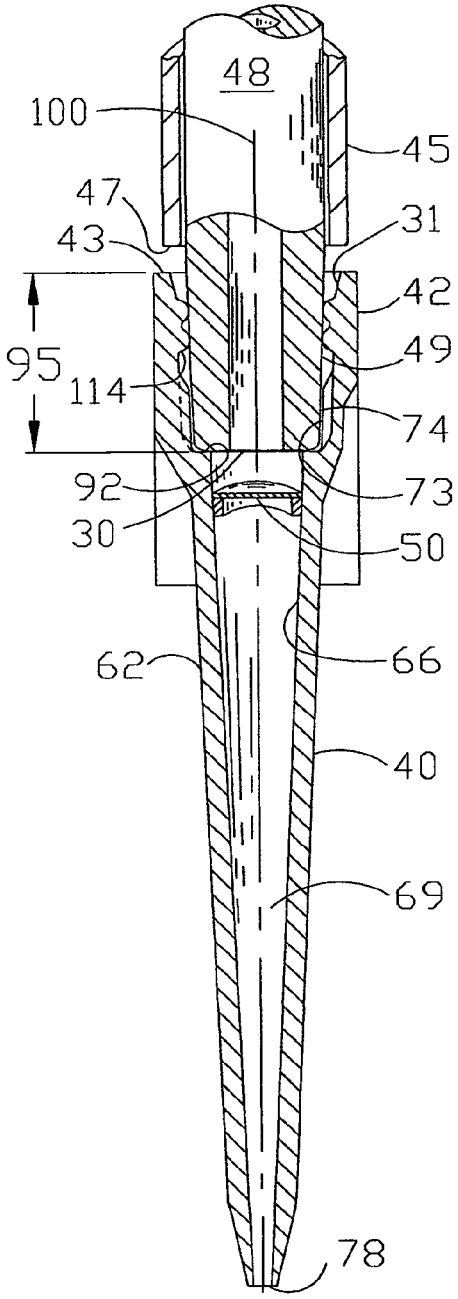
FIG. 8 is a cross section of a new pipette tip with a pipetter barrel installed to a predetermined depth. The two lobed sealing protrusions provide twice the sealing surface which means less radial squeeze is needed for sealing the barrel resulting in less friction. The pipetter barrel is supported by the lateral support zone or region of the elongated tubular tip which is constructed of small inward facing vertical ribs assuring the central axis of the pipette tip and the pipetter are the same. A shoulder or stop is shown for insuring uniform depth of penetration of the distal end of the pipetter barrel to assure uniform tip interference at the sealing protrusions with each barrel installed.
Figure 8B:
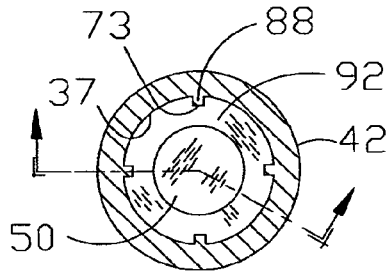
FIG. 8B is a cross section of FIG. 8A as designated by the section arrows shown through the lateral support region showing the rib supporting structure.
Figure 8A:
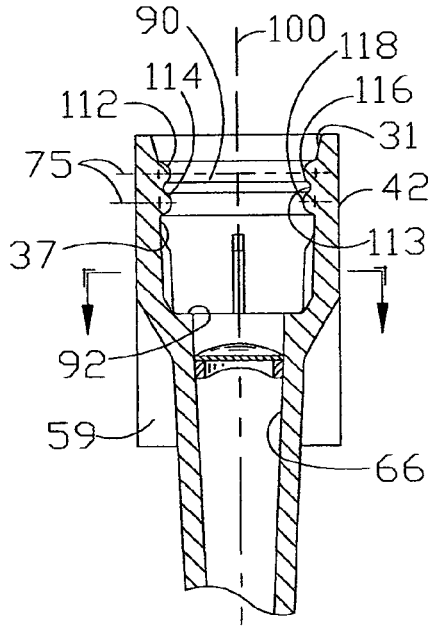
FIG. 8A is a fragmented cross section of the pipette tip as shown in FIG. 8 with the pipetter removed for clarity. The section detail is taken as shown by the arrows of FIG. 8B. A membrane filter is also shown in the pipette tips lower cavity.

FIGS. 8,8A and 8B illustrates an embodiment similar to that shown in FIG. 7 with the addition of a mechanical stop or ledge 92 as shown and described in prior embodiments. The mechanical stop or ledge 92 is shown to limit the penetration of the distal end 30 of the pipetter barrel 48 to a predetermined insertion depth 95 within central receiving cavity 90. This again, provides cooperation between the pipetter sealing surface 49 and the sealing surfaces 116 and 118 of the sealing protrusions 112 and 114 respectively to insure the correct diametrical interference between these two parts is established to provide the correct squeeze to insure that the axial installation and injection forces are controlled and are engineered to be below 3 pounds and preferably below 1 pound to prevent user injuries as previously discussed.

FIGS. 9, 9A, 9B, 9C and FIG. 10 depict a similar embodiment as describe in FIG. 6 including axial spaced walls 102 created by axial spaced slots 114 formed into the upper portion 42 of the elongated tubular member 62. These slots 114 orient and locate the ribs 106 of the sealing member 99 as it is positioned and fused to the upper portion 42 as shown in FIGS. 9A, 9B, 9C and FIG. 10. Similar to FIG. 6 the axial spaced ends 103 of wall 102 mate with the rib walls 107 of ribs 106 creating a hermetic seal. In addition, the outward facing surfaces 72 of the sealing protrusions 65 also mates with the inward facing surfaces 37 and 71 of the central receiving cavity 90 forming an hermetic seal.

The orientation of the slots 114 insures that the sealing protrusions 65 are co-axial and generally perpendicular to the longitudinal axis 100 of the tubular member 62. The outside longitudinal surface 115 of rib 106 is preferably flush with the outside circumferential wall 70 of upper portion 42 as shown in FIGS. 9A and 9C. This provides the capability of adding colorant to the sealing member 99 and thus being able to see the colored sealing material through the sidewall as longitudinal stripes about the circumference of the upper portion 42. This allows the manufacturer to color code the pipette tip for its volume, size, test or use that is very valuable to the end user. It is understood that the stripes may be horizontal or be configured in other ways such as but not limited to dots created through openings in the sidewall 70 of the upper portion 42 without departing from the scope of this invention.

Figure 9:
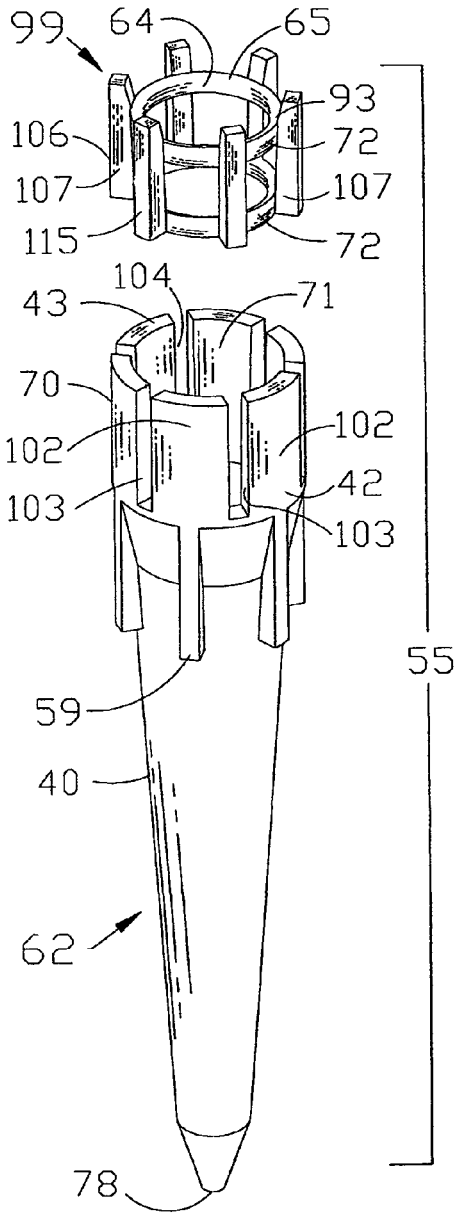
FIG. 9 is the exploded view of an alternate embodiment of the two parts, two material pipette tip. The elastomeric sealing member is shown individually before being installed or molded into the receiving cavity of the elongated tubular member. The axial slots shown in the upper portion of the elongated tubular member allows for orientation and attachment of the sealing member into the receiving cavity making a hermetic seal between the two materials.
Figure 9A:
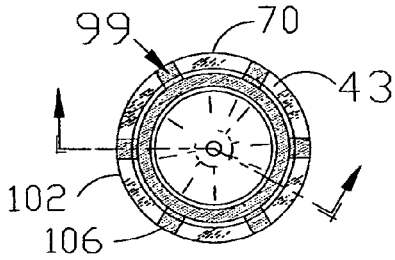
FIG. 9A is a top view of the two material tip as illustrated in FIG. 9 shown fully assembled. The elastomeric sealing member can be colored and seen from the top and outside upper portion as stripes for identification purposes.
Figure 9B:
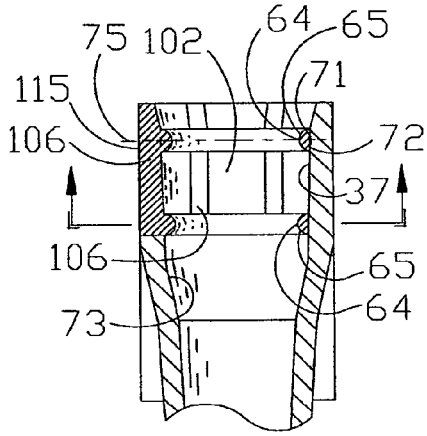
FIG. 9B is a cross section of FIG. 9 shown fully assembled as depicted by the section arrows shown in FIG. 9A The sealing member is molded and located into place through the axial slots of the elongated tubular member. The annular portion beneath the sealing member can provide an inwardly and downwardly tapering lateral support zone created by the elongated tubular member for the distal end of an installed pipetter barrel.
Figure 9C:
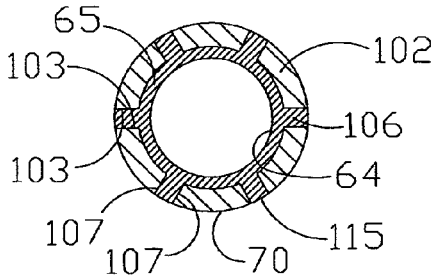
FIG. 9C is a cross section of FIG. 9B as designated by the section arrows shown through the two annular sealing ring protrusion which are perpendicular to the longitudinal axis of the tubular member. The sealing protrusions are molded and located into place through the axial slots of the elongated tubular tip, providing axial ribs protruding through the outside surface of the elongated tubular tip.
Figure 10:
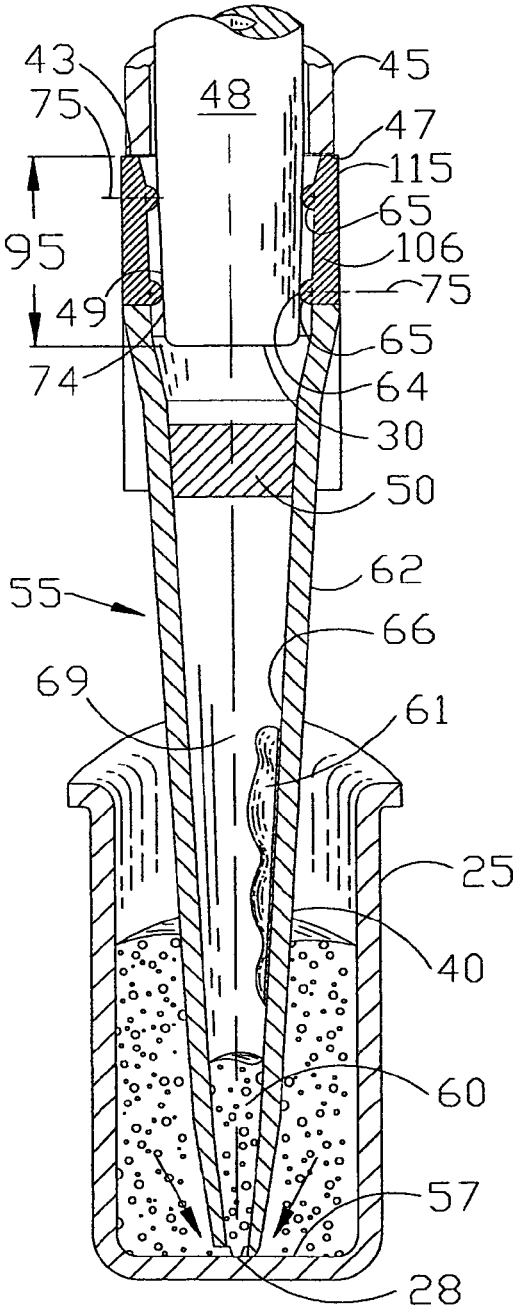
FIG. 10 illustrates the pipetter barrel being installed and mating with the annular protrusion sealing rings of the sealing member as shown in FIG. 9. The insertion depth in this embodiment is predetermined by the ejector sleeve contacting the top surface of the pipette tip. It also includes an optional apex end configuration for insuring fluid transfer when the apex end of the pipette tip contacts the surface of a container by providing channels for the fluid to flow.

FIG. 10 shows the pipette tip 55 with the sealing member 99 assembled to the tubular member 62 as previously described in FIG. 9. The first sealing protrusion 65 is adjacent the entrance to the central cavity 90 where the pipetter ejector sleeve 45 bottom surface 47 has contacted the top surface of the upper portion 42, thereby creating a predetermined stop controlling the insertion depth 95 into the receiving cavity 90. Adjacent the lowermost portion 74 of the pipetter barrel sealing surface 49 is the second sealing protrusion 65 of sealing member 99. Unlike previous embodiments, the spacing of the two or more protrusions 65 are distanced over the entire sealing length of the pipetter barrel sealing surface 49. In this construction the second or lower protrusion 65 acts not only as a sealing surface but also centers and locates the pipetter barrel 48 with the longitudinal central axis 100 of the tip 55. This lowermost secondary sealing protrusion also prevents rocking during the touching off of the pipetter tip during fluid transfers. It is also understood that the sealing protrusion or protrusions 65 can be created or fused onto the inward facing surface 71 or 37 of the receiving cavity 90 without the necessity of the axial support ribs 106 without departing from the scope of this invention.

In this embodiment the lower portion 40 of the tubular member 62 is shown aspirating a fluid sample 60 from a container or tube 25. The fluid 60 is drawn into the tip cavity 69 where the inside wall 66 of tip cavity 69 has been coated with a predetermined quantity of a dry reagent or reactant 61. This would permit the introduction of a pre-introduced known quality of dried reagent or reactant 61 with a predetermined amount of sample fluid 60 into the pipette tip cavity 69 of pipette tip 55 allowing it to contact and mix to perform a particular diagnostic test or other reactions. This not only saves valuable time and additional vials or containers that are normally used for this purpose but more importantly uses the entire sample the pipette tip draws within its cavity 69 since none is lost due to the transfer from one vial to another.

Figure 10A:
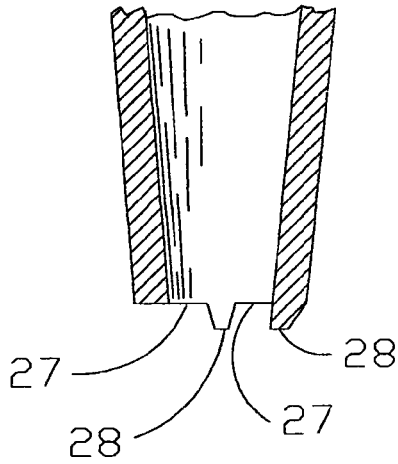
FIG. 10A is an enlarged cross sectional view of the apex end shown in FIG. 10
Figure 10B:
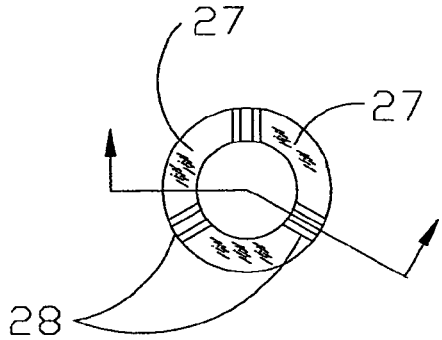
FIG. 10B is a bottom view of FIG. 10A showing the fluid channels.
Figure 11:
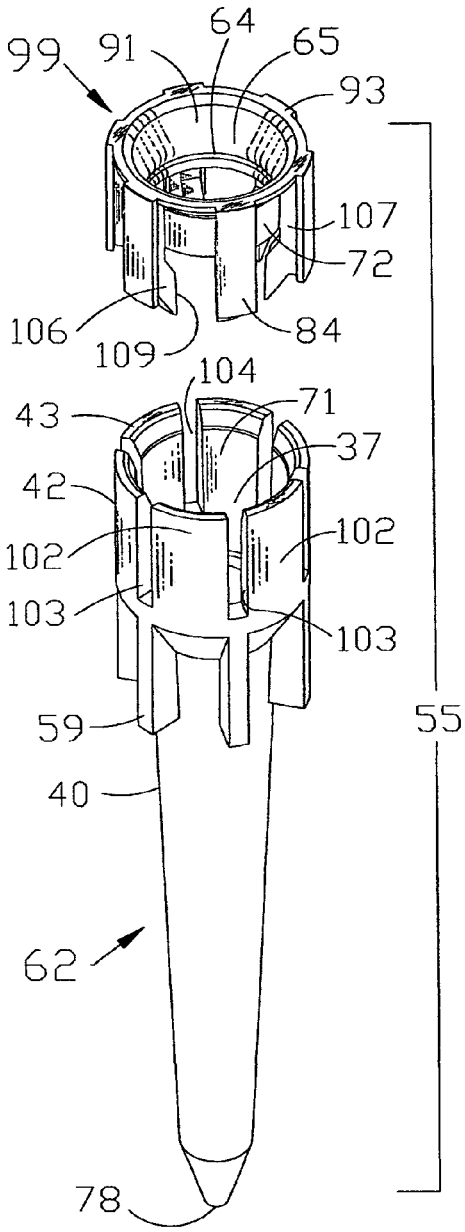
FIG. 11 is the exploded view of an alternate embodiment of the two parts, two material pipette tip. The elastomeric sealing member is shown individually before being installed or molded into the receiving cavity of the elongated tubular member.
Figure 11C:
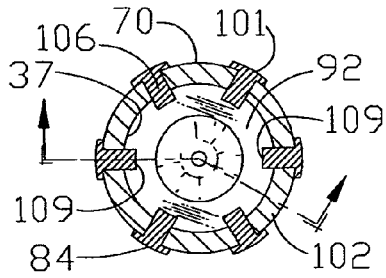
FIG. 11C is a cross section of FIG. 11B as designated by the section arrows shown through the lateral support zone or region. The lateral support zone is showing but is not limited to 6 inwardly facing axial spaced ribs constructed from the sealing elastomer material of the sealing member. It is understood that the sealing member can be created on the surface of the receiving cavity and outside surface of the elongated tubular member without the need of axial ribs.
Figure 11B:
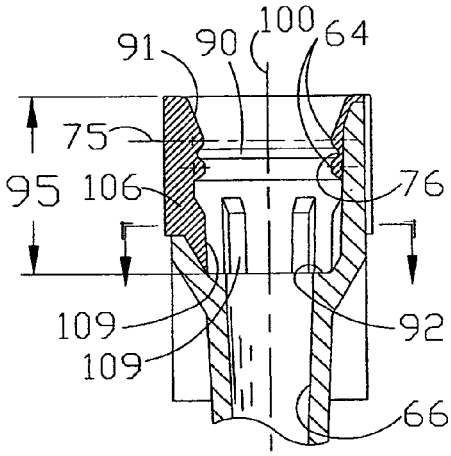
FIG. 11B is a cross section of FIG. 11 shown fully assembled and sectioned as depicted by the arrows in FIG. 11C. The sealing member includes the two lobed sealing protrusions that are molded and positioned into place through the axial slots or holes located in the elongated tubular member. In addition, the sealing member also includes a lateral support zone created from inwardly and downward tapering support ribs which are slightly less than or substantially equal to the outside surface of an installed pipetter barrel. Also shown is an optional shoulder or stop formed from the elongated tubular member to limit the penetration of the distal end of the barrel.
Figure 11A:
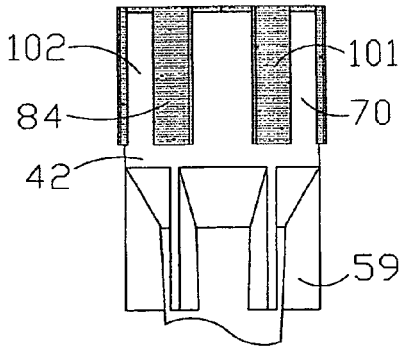
FIG. 11A is a fragmented side view of the fully assembled tip as shown in FIG. 11. The outside surface of the elongated tubular member is depicted with vertical elastomeric ribbing or stripes that provide structural integrity to the elastomeric material but also provide for identification purposes depending on the amount of slots or the color of the vertical ribbing.

Referring to FIGS. 10A and 10B, the end of apex 78 has been modified with a improved embodiment to eliminate the potential plugging or clogging that can occur when the pipette tip 55 contacts the inner or bottom surface 57 of a container 25. Collection channels 27 are formed between the tip feet 28 of the apex end 78 of pipette tip 55. They have the advantage of collecting the last remaining sample from container 25. This is because the discrete channels 27 are formed between the bottom surface 57 of the container 25 and the feet 28 when the pipette tip contacts the container bottom surface 57. This allows the fluid sample 60 to be drawn inside the tip cavity 69 while the apex end 78 is in contact with the bottom surface 57 of the container 25.

FIGS. 11, 11A, 11B and 11C describe an alternative embodiment as that as shown previously. In this embodiment the elastomeric sealing member 99 includes the addition of the lateral support surfaces 109 that are also created from the elastomeric material that forms the axial support ribs 106. This configuration is engineered to allow for contact between the elastomeric lateral support surface 109 and the lowermost portion 74 of the sealing surface 49 of the pipetter barrel 48. Unlike the previous embodiments the predetermine squeeze or interference between these two parts will not increase the axial forces necessary to eject the pipette tip from the pipetter. Prior embodiments incorporated the more rigid material from the tubular member 62 to create the lateral support ribs 88. In using the more rigid material of tubular member 62, a preferred very small clearance or minimal contact between the parts was desired to insure that the axial force for ejection did not increase. The elastomeric lateral support surfaces 109 allow for greater interference and support without the need for close tolerances as with prior embodiments.

Figure 12A:
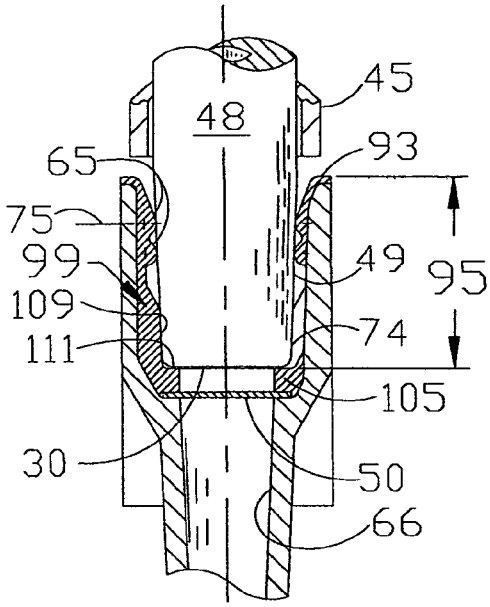
FIG. 12A is a cross section of FIG. 12 as shown by the segmented arrows depicted in the FIG. 12D. The sealing member including a two-lobed sealing protrusion is molded and located into place through the axial slots or holes through the elongated tubular member. In addition to the sealing protrusions the elastomeric sealing member is also used to create a shoulder or stop and a lateral support region made from inwardly and downward tapering support ribs which are slightly less than or substantially equal to the outside surface of an installed pipetter barrel. Also shown is an optional filter membrane sandwiched between the elastomeric stop or flanged ribbed portion and the shoulder of the more rigid elongated tubular member of the pipette tip.
Figure 12D:
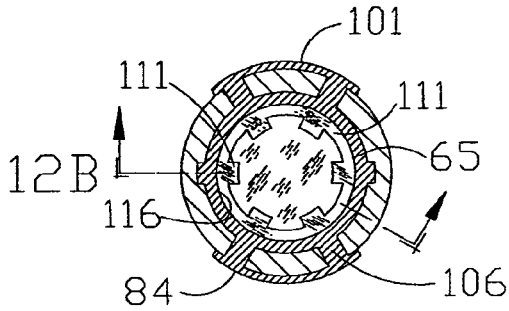
FIG. 12D is a cross section of FIG. 12B as designated by the section arrows shown through a sealing protrusion which is perpendicular to the axis of the tip. The sealing member is connected through the axial slots or openings within the elongated tubular member to provide structural integrity and an outside elastomeric surface to the upper portion. It is understood the protrusions, lateral support ribs and stop can be created on the surface of the receiving cavity without the need of the axial ribs.
Figure 12C:
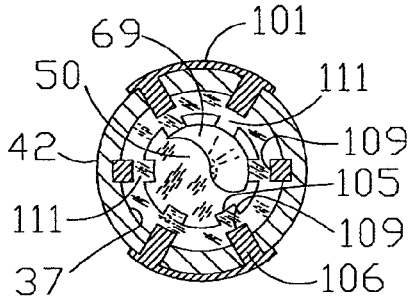
FIG. 12C is a cross section of FIG. 12B as designated by the section arrows shown through the lateral support region. The lateral support region is showing but is not limited to 6 inwardly facing axial spaced ribs constructed from the sealing elastomer material of the sealing member. The sealing member including the protrusions, ribs and stop are molded and located into place through the axial slots and protrude through the outside wall of the pipette tip in this embodiment to provide an additional outside surface for identification. Also illustrated is a filter that has been sectioned to show the inner cavity of the lower portion of the pipette tip
Figure 12:
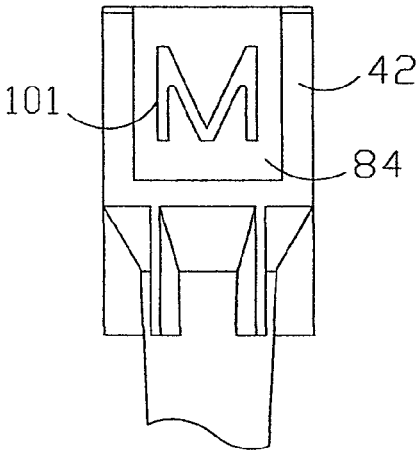
FIG. 12 is a fragmented side view of the fully assembled tip similar to that as shown in FIG. 11 but with outside markings that can include a letter, letters, numbers, stripes both vertical and horizontal or a combination of the above to better clarify the nature or the use of the new ergonomic pipette tip.

FIGS. 12 through 12D illustrate a sealing member 99 very similar to that as shown in prior embodiments with the addition of a few new features. First, the sealing member 99 incorporates a mechanical stop formed from individual flanged ribs 105 with each having a top surface or ledge 111 that is generally perpendicular to the central axis 100 constructed from the elastomeric material and not from the rigid tubular member 62 as previously disclosed as ledge 92 in prior embodiments. This in cooperation with the elastomeric lateral support ribs 106 each having a lateral support surface 109 that is co-axial with the barrel 48 provides circumferential support in a longitudinal direction to the lowermost portion 74 of the pipetter barrel 48 sealing surface 49 when the pipetter barrel 48 is inserted into the receiving cavity 90 a predetermine insertion depth 95 as shown in FIG. 12A.

Figure 12B:
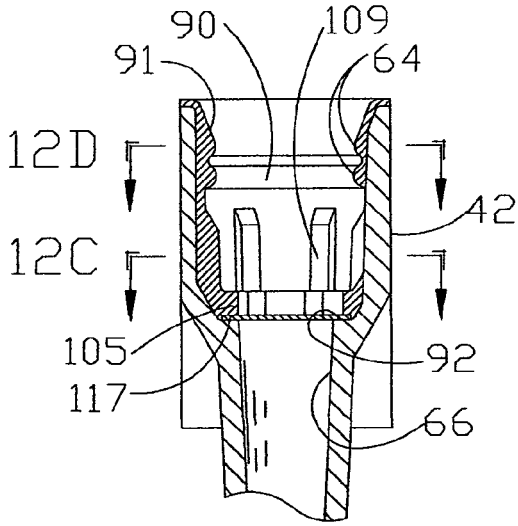
FIG. 12B is a cross section similar to that of FIG. 12A with the pipetter barrel removed for clarity showing the inwardly and downward tapering lateral support ribs and stop to limit the penetration of the barrel while maintaining consistence interference between the barrel and the sealing protrusion surfaces.

Furthermore, FIG. 12B shows the flanged rib portion 105 of sealing member 99 which includes the top face 111 that forms a stop for the distal end 30 of the pipetter barrel 48 also includes a bottom surface 117. This bottom surface 117 is also generally perpendicular to the longitudinal axis 100. The perimeter edge of filter membrane 50 is sandwiched between the bottom surface 117 of the elastomeric sealing member 99 and the perimeter ledge 92 of the tubular member 62 forming a hermetic seal.

The filter membrane 50 would be preferably installed at the time of the two shot insert molding process. In this process the elongated tubular member 62 is molded in the first material, the injection mold would then open and a new injection mold core defining the parameters of the sealing member 99 would be installed into the upper portion 42 of the tubular member 62. The optional membrane filter 50 would be installed at this time over the opening formed about the perimeter ledge 92 in the upper portion 42 and held in place by the new injection mold core that will create the sealing member 99. The sealing member 99, which is created by a tool cavity formed in the new core, would then be filled with a second shot of elastomeric material forming a hermetic seal about the circumference of the filter 50. Its location is such that it is below barrel 48 and above the maximum calibrated volume of sample fluid 60 that the pipette cavity 69 of pipette tip 55 is calibrated to hold. Under normal operations there should exist airspace between the fluid 60 and the filter 50 such that no fluid contact of the filter should occur. The preferred two-shot injection molding process insures that with compatible resins that the sealing member 99 becomes fused to the elongated tubular member 62 with the filter membrane hermetically sandwiched between the two parts and becomes an integral sterile one piece assembly.

In addition, as shown in FIG. 12 the outside surface 70 of upper portion 42 can be created with an segmented outside band portion 84 that can depict a letter or insignia 101 that can describe the type, size, volume or possible test that the particular ergonomic pipette tip can perform. This band portion 84 is formed from the elastomeric material that creates the sealing member 99 and thus be able to be color coded for further identification requirements.

Figure 13:
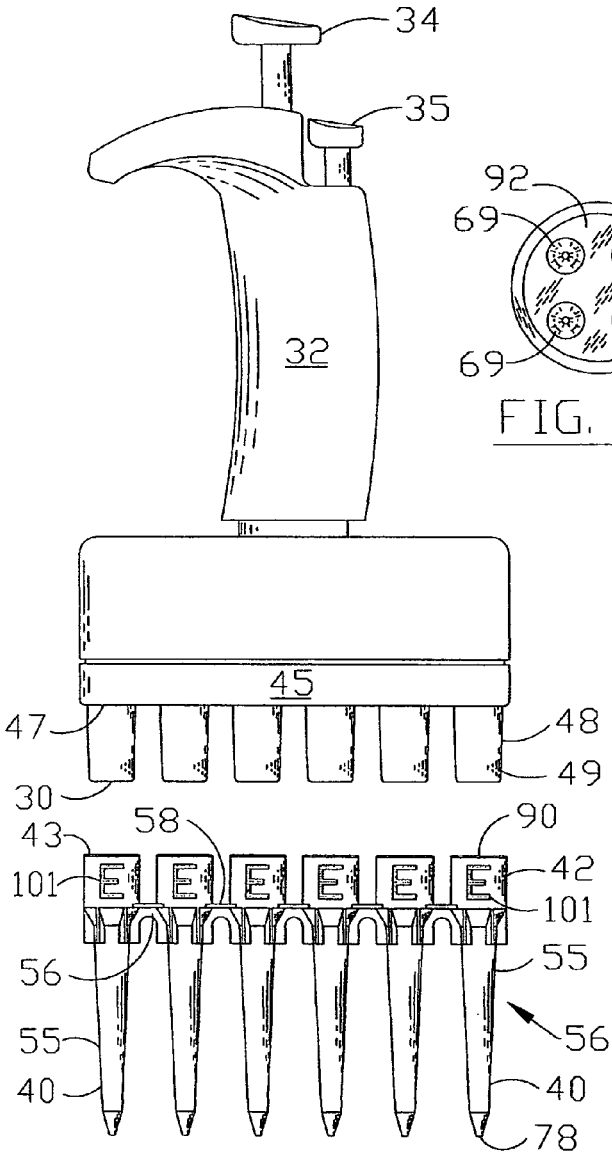
FIG. 13 illustrates a multi-channel pipetter with 6 barrels ready to be installed into a new ergonomic multi-pipette tip comprising 6 ergonomic pipette tips all connected together by ribs. This configuration shown is for illustration purposes only and can accommodate any multiple numbers of the described ergonomic tips in the prior figures including but not limited to 2, 4, 8 or 12 or more pipette tips.

FIG. 13 illustrates the ergonomic pipette tip 55 being molded together by means of ribs 58 to adapt to a standard multi-channel pipetter similar to those manufactured by Oxford, Brinkman, Eppendorf etc. These multi-channel pipetters work very similar to the single channel version as shown in FIG. 14 with the exception that it will pick up 4, 6, 8, 10, 12 etc. individual pipette tips at one time. FIG. 13 shows the new improved ergonomic multi-pipette tip 56 molded in a one-piece configuration by means of one or more thin ribs 58. This embodiment allows the manufacturer to mold the multi-tip 56 configurations for easier handling and at a lower cost than individual pipette tips. This multi-tip 56 embodiment offers the users ease and consistency of use during the sealing mode operation by limiting the rocking of individual tips, as is the case in prior art. The connecting rib or ribs 58 insures that all of the pipette tips 55 stay in a vertical alignment with the pipetter barrel 48 and insure the apex end 78 of the tips are constructed symmetrical and that the orientation or alignment is as-molded in line with the other pipette tips.

The multi-channel pipetter 32 with individual pipetter barrels 48 is shown ready to being installed into the strip of the new multi-channel ergonomic pipette tips 56. Normal prior art procedure would be to contact, penetrate, prevent rocking, and seal the 6 individual pipette tips that are not elastic in nature. Each of these individual tips can require from 14 and up to 25 lbs of axial force to install as previously discussed causing even greater strain on the user to insure that all of the tips are sealed and positioned for use when installing individual pipette tips at one time. Unlike prior art, these new ergonomic pipette tips 56 offer easy alignment and ease of penetration because of the elastomeric interface of the new ergonomic pipette tip design while keeping the total axial force to a minimum.

In normal use, the multi-channel pipetter 32 includes a push button 34 connected to a rod or rods located within the multi-channel pipette body or housing. The push button 34 may be depressed by a user after the tips have been installed exerting a downward force causing a downward movement of a piston or pistons within the pipetter 32. When the push button 34 is released, a predetermined quantity of sample 60 is aspirated into each of the pipette tips 55. The samples may then be transported to another vessel and then dispensed by once more exerting a downward force on push button 34. After such use, it is common practice to eject the pipette tips 56 from the pipetter barrel 48 by applying a downward force to the ejector button 35. This in turn is connected to a rod that operates a downward movement of the ejector sleeve 45 that ejects the pipette tips from the each and every barrel 48. Again the axial forces normally required are increased do to the additional tips that must be removed when using these multi-channel pipetters. However, in this new embodiment the elastic nature of the new ergonomic pipette tips 55 combined with the attachment providing predetermined alignment offers reduced axial ejection forces than that seen in prior art.

These multi-channel pipetters were developed primarily to increase the number of dispensing one was capable of doing at one time. This new ergonomic multi-pipette tip 56 shown in FIG. 13 will help not only to reduce the fatigue associated with these devices but also provide for faster interchange between parts and or assemblies. They are particularly useful to fill or remove fluid from standard 96 (8×12) microwell plates on 9 mm centers or even smaller plates like the newer 384 well plate (16×24) with 4.5 mm centerline spacing as well as a 1,536 well (32×48) with 2.25 mm spacing which has just begun production. As samples become more valuable and more testing is required, these well plates will continue to get smaller as well as the tubes and containers of the future.

FIG. 14 illustrates a standard pipetter 33 with barrel 48 shown ready to be installed into the upper portion 42 of a new embodiment of the ergonomic pipette tip. In this embodiment, the upper portion 42 is constructed as in the previous embodiments which contain many variations including an elastomeric sealing member, a two-lobed sealing surface for sealing engagement with the pipetter barrel 48 inserted into the entrance of the receiving cavity 90 and other innovations. This new embodiment or multi-pipette tip 52 is constructed with two or more lower portions 40 each having its own apex end 78 and pipette tip cavity 69 for communication with the central receiving cavity 90 of the upper portion 42. FIG. 14A illustrates a top view as shown by the arrows in FIG. 14 of the upper portion 42 illustrating four lower portions 40 with four tip cavities 69 and the perimeter ledge 92 surrounding the upper edge surface of those cavities. It is also understood that a filter 50 could be placed over these openings and could be fused or coupled to the perimeter surface of the ledge 92 without departing from the scope of the invention.

These multiple lower portions 40 allow the user to dispense multiple liquid samples while only aspirating one fluid sample using a single barrel pipetter. This becomes very beneficial when a large number of dispensing must be made and is especially useful when working with well plates and the like. As the samples become smaller, more testing is required and the tray wells continue to increase from say the standard 96 well plate to the 384 and again to 1536, there exist a real need to accommodate this growth with new and innovative products such that are described throughout this patent.

Be it known that any element or feature of the embodiments disclosed in this application can be directed and used with other elements or features of other embodiments disclosed within this application without departing from the scope of my invention. For example, the tubular element 41 as shown in FIG. 7 or the pipette tip feet 28 creating collection channel 27 as shown in FIG. 10 can be incorporated into any apex end 78 as described in any ergonomic pipette tip embodiment disclosed including but not limited to the multi-channel tips as shown in FIGS. 13 and 14.

It is believed that many advantages of this invention will now be apparent to those skilled in the art. It will also be apparent that a number of variations and modifications may be made therein without departing from its spirit and scope. Accordingly, the forgoing description is to be construed as illustrative only, rather than limiting. This invention is limited by the scope of the following claims.

BRIEF DESCRIPTION OF NUMBERED PARTS

25 Container, Tube or Vessel
26 Recess Grove in Prior Art Tip
27 Collection Channels—Apex end 78
28 Pipette Tip Feet—Apex End 78
29 Not Used
30 Distal End of Pipetter Barrel 48
31 Guide Surface—Upper Portion 42
32 Multi-Channel Pipetter
33 Standard Pipetter
34 Push Button—Pipetter
35 Push Button—Ejector
36 Not Used
37 Inward Facing Surface of Central Receiving Cavity 90
38 Seal Between Apex End 78 and Tubular Element 41
39 Outer Surface of Tubular Element 41
40 Lower Portion of Elongated Tubular Member 62
41 Tubular Element—Tunnel Shaped
42 Upper Portion of Elongated Tubular Member 62
43 Top Face Surface—Upper Portion 42
44 Inside Sealing Surface of Apex End 78
45 Ejector Sleeve
46 Apex End of Tubular Element 41
47 Bottom Ejecting Surface of Ejector Sleeve 45
48 Pipetter Barrel
49 Pipetter Barrel Sealing Surface
50 Filter Membrane or Plug Filter
51 Container Cap or Septum
52 Multi-Tip with One Upper 42 and Multiple Portions 40
53 Not Used
54 Support Tray Holes—Support Tray 63
55 Ergonomic Pipette Tip
56 Multi-Channel Tip with Multiple Pipette Tips 55
57 Inside Bottom Surface of Container 25
58 Multi-Channel Pipette Tip Connecting Ribs
59 Axial Spaced Support Ribs—Upper Portion 42
60 Fluid (Sample)
61 Predetermined Amount of Dry Reagent/Reactant
62 Elongated Tubular Member or Tubular Receptacle
63 Support Tray Surface—Storage Rack
64 Sealing Contact Surface of Sealing Protrusion 65
65 Sealing Ring Protrusion—Arched or other Profiles
66 Inside Wall of Tip Cavity 69
67 Filter Ring for Holding Filter Media
68 Not Used
69 Pipette Tip Cavity for holding Fluid 60
70 Pipette Tip Outer Surface
71 Inward Facing Surface towards Surface 72
72 Outward facing Surface of Sealing Member 99
73 Lateral Support Zone or Lateral Support Surfaces
74 Lowermost Portion of Sealing Surface 49
75 Protrusion Sealing Axis—Perpendicular to Axis 100
76 Arched Shaped Recess between Protrusions 65
77 Upper Edge Portion—Upper Portion 42
78 Apex End of Tubular Member 62
79 Prior Art Pipette Tip—Two Materials
80 Elongated Sealing Collar—Prior Art Tip 79
81 Tubular Member—Prior Art Tip 79
82 Inner Surface of Collar 80—Prior Art Tip 79
83 Central Axis of Elongated Sealing Collar 80
84 Outside Flange Portion—Sealing Member 99
85 Bottom Face of Flange Portion 84
86 Inward Facing Surface of Flange Portion 84
87 Upward Facing Surface of Flange Portion 84
88 Lateral Support Ribs from Tubular Member 62
89 Back Surface of Lead-in Guide—Member 99
90 Central Receiving Cavity
91 Lead-in Guide Surface—Member 99
92 Perimeter Ledge or Rib—Stop—Member 62
93 Top Surface of Flange Portion 84
94 Not Used
95. Insertion Depth of Barrel 48 into Cavity 90
96 Not Used
97 Not Used
98 Bottom Face of Upper Edge Portion 77
99. Sealing Member—Elastomer
100 Longitudinal Central Axis
101 Insignia—Letter, Color, Stripe, Dot or Number
102 Axial Space Wall Sections of Upper Portion 42
103 Axial spaced Ends forming Wall 102
104 Axial Formed Slots in Upper Portion 42
105 Flanged Rib Portion—Stop-Sealing Member 99
106 Axial Support Rib for Sealing Member 99
107 Rib Wall of Support Rib 106
108 Outward Facing Surface of Edge Portion 77
109 Lateral Support Surface of Support Rib 106
110 Tunnel Shaped Aperture
111 Perimeter or Segmented Ledge-Stop-Member 99
112 First Sealing Ring Protrusion-Upper Portion 42
113 Recess Grove between 112 and 114 Rings
114 Second Sealing Ring Protrusion-Portion 42
115 Outside Longitudinal surface of Rib 106
116 Sealing Surface of First Protrusion 112
117 Bottom Surface of Fanged Portion 105
118 Sealing Surface of Second Protrusion 114

The invention claimed is:

1. A pipette tip comprising:

an elongated tubular receptacle; and a sealing member, wherein the elongated tubular receptacle is made from a first material and includes a upper portion with a receiving surface facing a central axis of the elongated tubular receptacle and defining a central receiving cavity, wherein the receiving surface is configured to receive the sealing member, said upper portion includes at least one axial spaced wall section having axial ends in a circumferential direction of said upper portion;

said sealing member made from a second material includes at least one sealing surface configured to provide a sealing surface for sealing engagement with a pipetter barrel inserted into said central receiving cavity, wherein said sealing member includes at least one rib coupled to said axial ends of said at least one axial spaced wall section of said upper portion, wherein said at least one axial spaced wall section and said at least one rib are engaged along the circumferential direction of said upper portion to define a circumference of said upper portion.

2. The pipette tip of claim 1 wherein said first material comprises a material selected from the group consisting of thermoplastics, thermoset plastics, fluorocarbon plastics, metals, steel, and glass.

3. The pipette tip of claim 1 wherein said second material comprises a material selected from the group consisting of thermoplastic elastomers, thermoplastic vulcanizates, thermoset elastomers, thermoplastic rubbers, elastoplastics, silicones, saturated and unsaturated rubbers.

4. The pipette tip of claim 1 wherein the sealing surface includes an arched-shaped sealing ring protrusion configured to face the central axis of said elongated tubular member.

5. The pipette tip of claim 1 wherein the sealing member is hermetically bonded to the upper portion of said elongated tubular member.

6. The pipette tip of claim 1 wherein the central receiving cavity of said upper portion includes at least one substantially cylindrical support surface which faces the central axis of the elongated tubular receptacle and is co-axial with the central axis of the elongated tubular receptacle, wherein the substantially cylindrical support surface is configured to provide lateral support when said pipetter barrel is received within said central receiving cavity of said upper portion of said elongated tubular receptacle.

7. The pipette tip of claim 1 wherein said central receiving cavity of said upper portion includes at least one mechanical stop below said sealing surface and extending inwardly from said receiving surface towards the center axis of said elongated tubular receptacle, wherein said mechanical stop extends in a direction substantially perpendicular to said central axis of the elongated tubular member and has an upper face configured to limit downward penetration of a distal end of said pipetter barrel when said pipetter barrel is inserted into said central receiving cavity of said upper portion of said elongated tubular receptacle.

8. The pipette tip of claim 7 wherein said central receiving cavity of said upper portion adjacent said mechanical stop includes at least one substantially cylindrical support surface which faces the central axis of the elongated tubular receptacle and is co-axial with the central axis of the elongated tubular receptacle, wherein the substantially cylindrical support surface is configured to provide lateral support when said pipetter barrel is received within said central receiving cavity of said upper portion of said elongated tubular receptacle.

9. The pipette tip of claim 1 wherein:

said upper portion of said elongated tubular receptacle includes means for ensuring uniform depth of penetration of said pipetter barrel inserted into said receiving cavity of said upper portion in order to maintain a uniform interference between said sealing surface of said sealing member and said pipetter barrel as successive pipette barrels are inserted into and ejected from said upper portion.

10. The pipette tip of claim 1 wherein said elongated tubular receptacle includes an inside cavity and apex end with opening for receiving a predetermine volume of fluid; and a filter extending across said pipette tip cavity of said elongated tubular receptacle.

11. The pipette tip of claim 1 wherein said elongated tubular receptacle includes an inside cavity and apex end with opening for receiving a predetermine volume of fluid wherein said apex end is configured to receive said fluid when said apex end is contiguous with a container bottom.

12. The pipette tip of claim 1 wherein said elongated tubular receptacle includes an inside cavity and apex end with opening for receiving a predetermine volume of fluid; and wherein said pipette tip cavity has an inside surface, said inside surface is coated with a predetermined amount of reagent or reactant configured to mix with said fluid when said fluid is drawn into said pipette tip cavity.

13. A pipette tip comprising:

an elongated tubular receptacle; and a sealing member, wherein the elongated tubular receptacle is made from a first material and includes a upper portion with a receiving surface facing a central axis of the elongated tubular receptacle, and defining a central receiving cavity, wherein the receiving surface is configured to receive the sealing member, said upper portion includes at least one axial spaced wall section with a top surface having axial ends in a circumferential direction of said upper portion, said sealing member made from a second material includes at least one sealing surface configured to provide a sealing surface for sealing engagement with a pipetter barrel inserted into said central receiving cavity, wherein said sealing member includes at least one rib coupled to said axial ends of said at least one axial spaced wall section of said upper portion, wherein said sealing member further includes an upper wall portion having a bottom surface coupled to said top surface of said at least one axial wall section along the circumferential direction of said upper portion to define a circumference of said upper portion.

14. The pipette tip of claim 13 wherein the at least one sealing surface includes an arched-shaped sealing ring protrusion configured to face the central axis of said elongated tubular receptacle for sealing engagement with said pipetter barrel inserted into said receiving cavity.

15. The pipette tip of claim 13 wherein the upper portion of the elongated receptacle includes an outside surface which faces away from the central axis of the elongated tubular receptacle, wherein the sealing member includes an outer portion with an inner surface coupled to said outside surface of said upper portion of said elongated tubular receptacle.

16. The pipette tip of claim 13 wherein the central receiving cavity of said upper portion includes at least one substantially cylindrical support surface which faces the central axis of the elongated tubular receptacle and is co-axial with the central axis of the elongated tubular receptacle, wherein the substantially cylindrical support surface is configured to provide lateral support when said pipetter barrel is received within said central receiving cavity of said upper portion of said elongated tubular receptacle.

17. The pipette tip of claim 13 wherein said central receiving cavity of said upper portion includes at least one mechanical stop below said sealing surface and extending inwardly from said receiving surface towards the center axis of said elongated tubular receptacle, wherein said mechanical stop extends in a direction substantially perpendicular to said central axis of the elongated tubular member and has an upper face configured to limit downward penetration of a distal end of said pipetter barrel when said pipetter barrel is inserted into said central receiving cavity of said upper portion of said elongated tubular receptacle.

18. The pipette tip of claim 17 wherein said central receiving cavity of said upper portion adjacent said mechanical stop includes at least one substantially cylindrical support surface which faces the central axis of the elongated tubular receptacle and is co-axial with the central axis of the elongated tubular receptacle, wherein the substantially cylindrical support surface is configured to provide lateral support when said pipetter barrel is received within said central receiving cavity of said upper portion of said elongated tubular receptacle.

19. The pipette tip of claim 13 wherein said elongated tubular receptacle includes an inside cavity and apex end with opening for receiving a predetermine volume of fluid; and a filter extending across said pipette tip cavity of said elongated tubular receptacle.

20. A pipette tip comprising:

an elongated tubular receptacle; and a sealing member, wherein the elongated tubular receptacle made from a first material having an upper portion with an receiving surface which faces a central axis of the elongated tubular receptacle, and defines a central receiving cavity wherein the receiving cavity is configured to receive the sealing member, said upper portion includes at least one axial spaced wall section having axial ends in a circumferential direction of said upper portion further including an outside surface that faces away from the central axis of the elongated tubular receptacle, wherein the sealing member is made from a second material providing at least one sealing surface for sealing engagement with a pipetter barrel inserted into said receiving cavity, wherein said sealing member includes an outer portion with an inner surface coupled to said outside surface of said upper portion, wherein said upper portion is sandwiched between said sealing surface and said outer portion such that the sealing member extends therebetween.

21. The pipette tip of claim 20 wherein said second material is a colored material selected to indicate a particular size, volume, chemical resistance or specific test said pipette tip can perform.

22. The pipette tip of claim 20 wherein said upper portion of said tubular receptacle includes at least one mechanical stop below said sealing surface of said sealing member and extending inwardly from said receiving surface towards the center axis of said elongated tubular receptacle, wherein said mechanical stop extends in a direction substantially perpendicular to said central axis of the elongated tubular member and has an upper face configured to limit downward penetration of a distal end of said pipetter barrel when said pipetter barrel is inserted into said central receiving cavity of said upper portion of said elongated tubular receptacle.

23. The pipette tip of claim 20 wherein the central receiving cavity of said upper portion includes at least one substantially cylindrical support surface which faces the central axis of the elongated tubular receptacle and is co-axial with the central axis of the elongated tubular receptacle, wherein the substantially cylindrical support surface is configured to provide lateral support when said pipetter barrel is received within said central receiving cavity of said upper portion of said elongated tubular receptacle.

24. The pipette tip of claim 20 wherein said elongated tubular receptacle includes an inside cavity and apex end with opening for receiving a predetermine volume of fluid; and a filter extending across said pipette tip cavity of said elongated tubular receptacle.

25. The pipette tip of claim 20 wherein said elongated tubular receptacle includes an inside cavity and apex end with opening for receiving a predetermine volume of fluid; and wherein said pipette tip cavity has an inside surface, said inside surface is coated with a predetermined amount of reagent or reactant configured to mix with said fluid when said fluid is drawn into said pipette tip cavity.

26. A pipette tip comprising:

at least one upper portion;

a sealing member; and a plurality of lower portions, wherein the at least one upper portion is made from a first material and Includes a receiving surface facing a central axis of the upper portion defining a central receiving cavity, wherein the receiving surface is configured to receive the sealing member, said upper portion includes at least one axial spaced wall section having axial ends in a circumferential direction of said upper portion;

said sealing member made from a second material and includes at least one sealing surface configured to provide a sealing surface for sealing engagement with a pipetter barrel inserted into said central receiving cavity, wherein said sealing member includes at least one rib coupled to said axial ends of said at least one axial spaced wall section of said upper portion, wherein said at least one axial spaced wall section and said at least one rib are engaged along the circumferential direction of said upper portion to define a circumference of said upper portion, wherein the plurality of lower portions each have an open end and a pipette tip cavity configured to hold a fluid, wherein each said pipette tip cavity is in communication with said central receiving cavity of said upper portion.

27. The pipette tip of claim 26 wherein each said pipette tip cavity includes a filter extending across each said pipette cavity.

28. The pipette tip of claim 26 wherein:

said at least one upper portion includes means for ensuring uniform depth of penetration of said pipetter barrel inserted into said receiving cavity of said upper portion in order to maintain a uniform interference between said sealing surface of said sealing member and said pipetter barrel as successive pipette barrels are inserted into and ejected from said upper portion.

29. The pipette tip of claim 26 wherein said plurality of lower portions each have an apex end that is configured to receive said fluid when said apex end is contiguous with a container bottom.

30. The pipette tip of claim 26 wherein the receiving surface of said central receiving cavity includes at least one substantially cylindrical support surface which faces the central axis of the upper portion and is co-axial with the central axis of the upper portion, wherein the substantially cylindrical support surface is configured to provide lateral support when said pipetter barrel is received within said central receiving cavity of said upper portion.

* * * * *